US010566724B2

(12) United States Patent
Hayashi et al.

(10) Patent No.: US 10,566,724 B2
(45) Date of Patent: Feb. 18, 2020

(54) CONNECTOR

(71) Applicant: Panasonic Intellectual Property Management Co., Ltd., Osaka (JP)

(72) Inventors: Takuya Hayashi, Mie (JP); Yuichi Shida, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/041,088

(22) Filed: Jul. 20, 2018

(65) Prior Publication Data

US 2019/0052009 A1 Feb. 14, 2019

(30) Foreign Application Priority Data

Aug. 9, 2017 (JP) ..... 2017-153989

(51) Int. Cl.
*H01R 13/11* (2006.01)
*H01R 24/20* (2011.01)
(Continued)

(52) U.S. Cl.
CPC ..... *H01R 13/112* (2013.01); *H01R 24/20* (2013.01); *H01R 12/778* (2013.01); *H01R 2107/00* (2013.01)

(58) Field of Classification Search
CPC ..... H01R 12/72; H01R 12/721; H01R 12/77; H01R 12/778; H01R 12/78; H01R 12/79; H01R 12/88; H01R 13/112
See application file for complete search history.

(56) References Cited

U.S. PATENT DOCUMENTS 5,906,498 A * 5/1999 Nagafuji ..... H01R 12/88 439/260
7,147,498 B1 * 12/2006 Gillespie ..... H01R 12/774 439/260

(Continued)

FOREIGN PATENT DOCUMENTS

JP 2011-222273 11/2011

*Primary Examiner* — Oscar C Jimenez
(74) *Attorney, Agent, or Firm* — Greenblum & Bernstein, P.L.C.

(57) ABSTRACT

A connector includes a housing configured to have an object component be inserted therein, and a terminal accommodated in the housing and configured to be conductively connected to the object component. The terminal includes a first base part, a second base part disposed apart from the first base part, and a joint part joining the first base part to the second base part. The joint part elastically deforms so as to move the second base part relative to the first base part. The first base part includes a base body and a mount portion connected to the base body at a first connection point. The mount portion is mountable onto an object device with a mount agent. The joint part includes a root portion joined to the base body and a displaceable portion connected to the root portion at a second connection point. The displaceable portion is displaceable relative to the root portion. A space preventing the mount agent from moving to the displaceable portion is formed around the terminal between the second connection point and the first connection point. This connector prevents connective connection with the object component from being obstructed.

15 Claims, 26 Drawing Sheets

(51) Int. Cl.
*H01R 12/77* (2011.01)
*H01R 107/00* (2006.01)

(56) References Cited

U.S. PATENT DOCUMENTS

2006/0084311 A1* 4/2006 Suzuki ..... H01R 12/771
439/260
2006/0183364 A1* 8/2006 Suzuki ..... H01R 12/79
439/260
2008/0113542 A1* 5/2008 Sunaga ..... H01R 12/79
439/260
2008/0233781 A1* 9/2008 Matoba ..... H01R 12/778
439/258
2009/0170367 A1* 7/2009 Hemmi ..... H01R 12/88
439/372
2009/0298319 A1* 12/2009 Takahashi ..... H01R 4/028
439/329
2010/0081312 A1* 4/2010 Kodaira ..... H01R 12/79
439/329
2011/0171844 A1* 7/2011 Chen ..... H01R 12/88
439/260
2014/0073155 A1* 3/2014 Kiyooka ..... H01R 12/88
439/157
2014/0342592 A1* 11/2014 Ashibu ..... H01R 12/79
439/267
2016/0218456 A1* 7/2016 Ashibu ..... H01R 12/88

* cited by examiner

CONNECTOR

TECHNICAL FIELD

The present invention relates to a connector.

DESCRIPTION OF RELATED ART

A conventional connector includes a housing and a terminal for electrically connected to an object component, such as an FPC and FFC. The terminal is accommodated in the housing (for example, see Japanese Patent Laid-Open Publication No. 2011-222273).

Japanese Patent Laid-Open Publication No. 2011-222273 discloses that the terminal having a structure that a stationary arm is jointed to a movable arm with by an elastically-deformable joint spring part. The stationary arm of this terminal further includes a mount portion to be mounted on a circuit board. The mount portion is soldered to the circuit board so as to mount the connector onto the circuit board while the terminal is accommodated inside the housing.

SUMMARY

A connector includes a housing configured to have an object component be inserted therein, and a terminal accommodated in the housing and configured to be conductively connected to the object component. The terminal includes a first base part, a second base part disposed apart from the first base part, and a joint part joining the first base part to the second base part. The joint part elastically deforms so as to move the second base part relative to the first base part. The first base part includes a base body and a mount portion connected to the base body at a first connection point. The mount portion is mountable onto an object device with a mount agent. The joint part includes a root portion joined to the base body and a displaceable portion connected to the root portion at a second connection point. The displaceable portion is displaceable relative to the root portion. A space preventing the mount agent from moving to the displaceable portion is formed around the terminal between the second connection point and the first connection point.

This connector prevents connective connection with the object component from being obstructed.

DETAILED DESCRIPTION OF PREFERRED EMBODIMENTS

Figure 1:
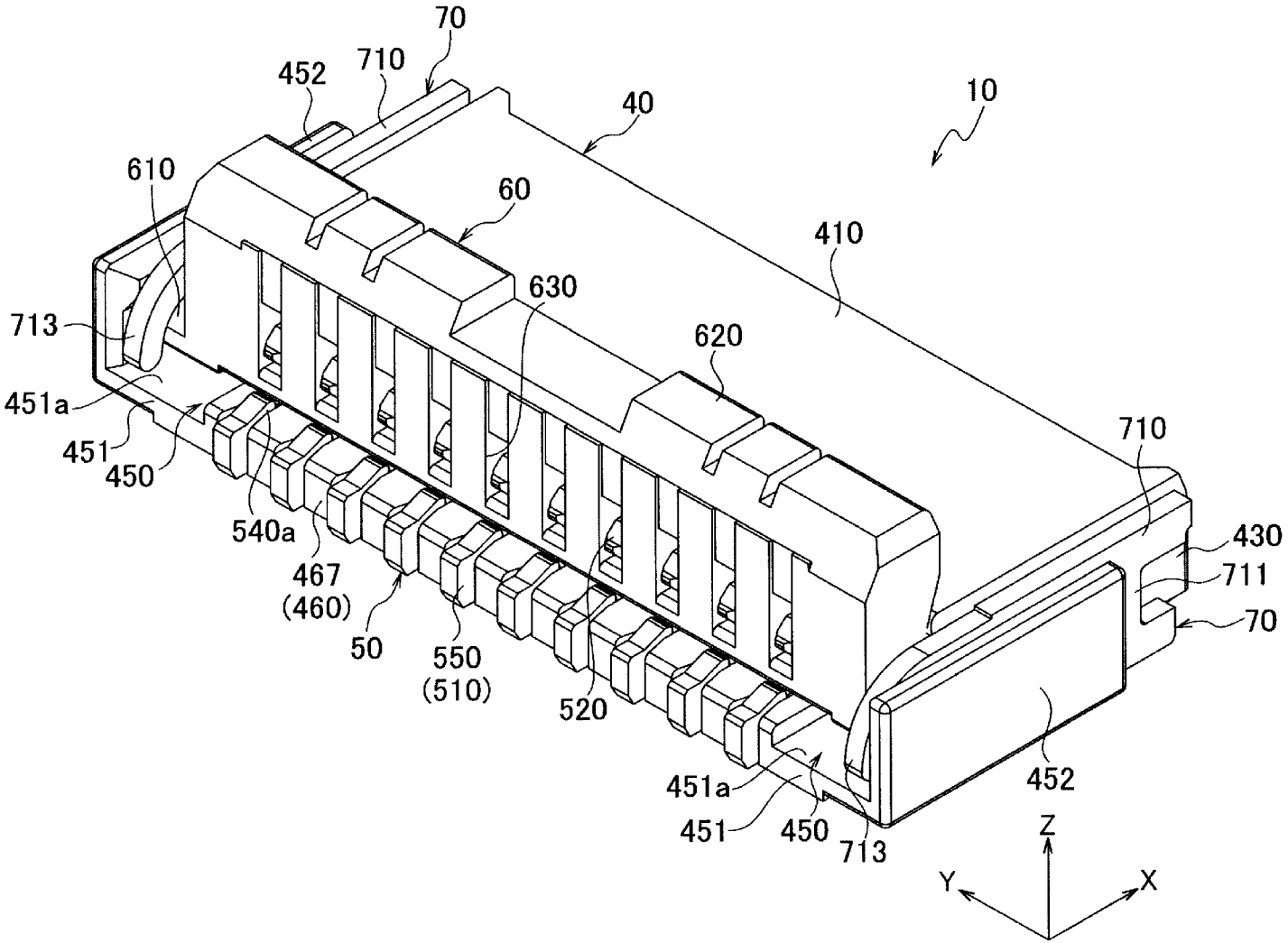
FIG. 1 is a perspective view of a connector according to Exemplary Embodiment 1 of the present invention.

Exemplary embodiments of the present invention will be described below with reference to the drawings. In the drawings, a front-rear direction X, a width direction Y, and an up-down direction Z which are perpendicular to each other are defined. The front-rear direction X is a direction in which a cable is inserted or removed. The width direction Y is a longitudinal direction of the housing, a direction in which contacts are arranged, and a direction in which a rotation axis of a lever extends. The up-down direction Z is a thickness direction of the housing, or a thickness direction of the inserted cable.

A direction in which the cable moves when the cable is removed from the housing, that is, a direction toward a side of the housing on which the cable is disposed is defined as frontward. On the other hand, a direction in which the cable moves when the cable is inserted into the housing, that is, a direction toward a side of the housing on which the lever of the housing is disposed is defined as rearward. The up-down direction is defined under the assumption that, when the connector is disposed so that the lever attached to the housing is located upward, a direction upward from the connector is defined as an upward direction.

The following exemplary embodiments contain like constituent elements. In the following, such like constituent elements are denoted by the same reference numerals, and the description thereof will not be repeated.

Exemplary Embodiment 1

Figure 2A:
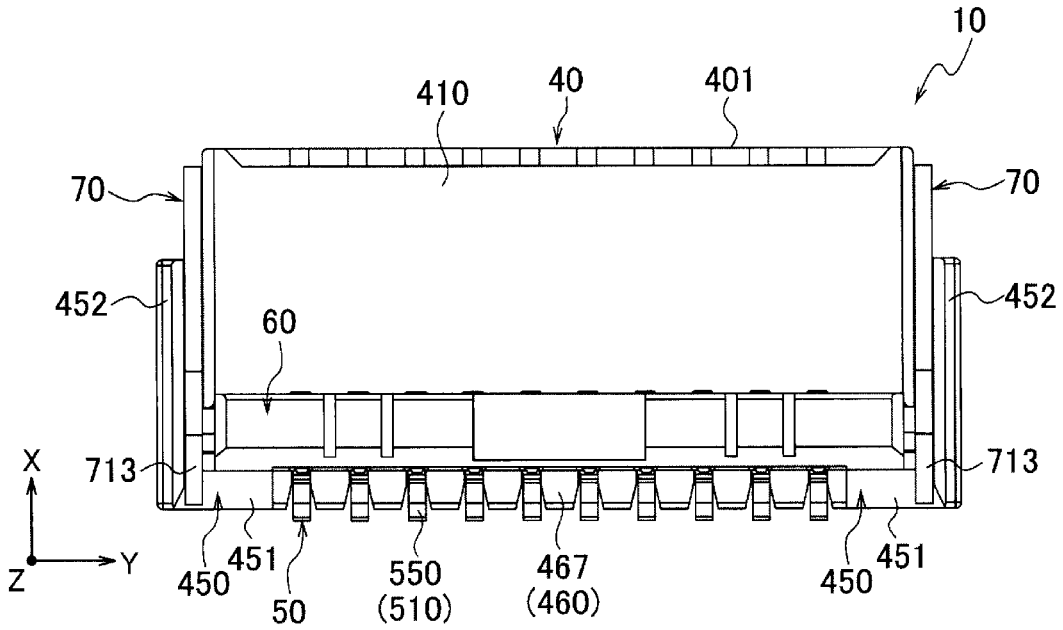
FIGS. 2A and 2B are a plan view and a rear view of the connector according to Embodiment 1, respectively.
Figure 2B:
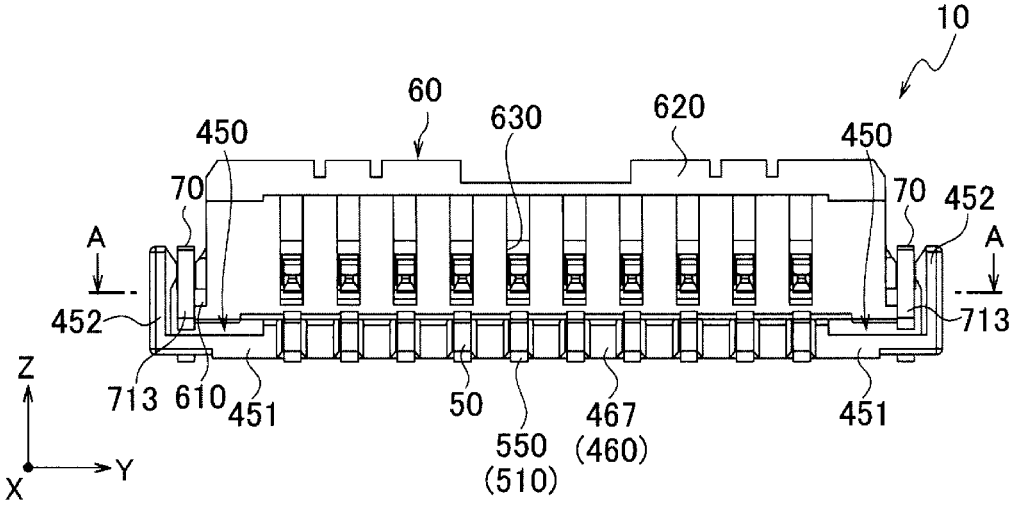
Figure 3:
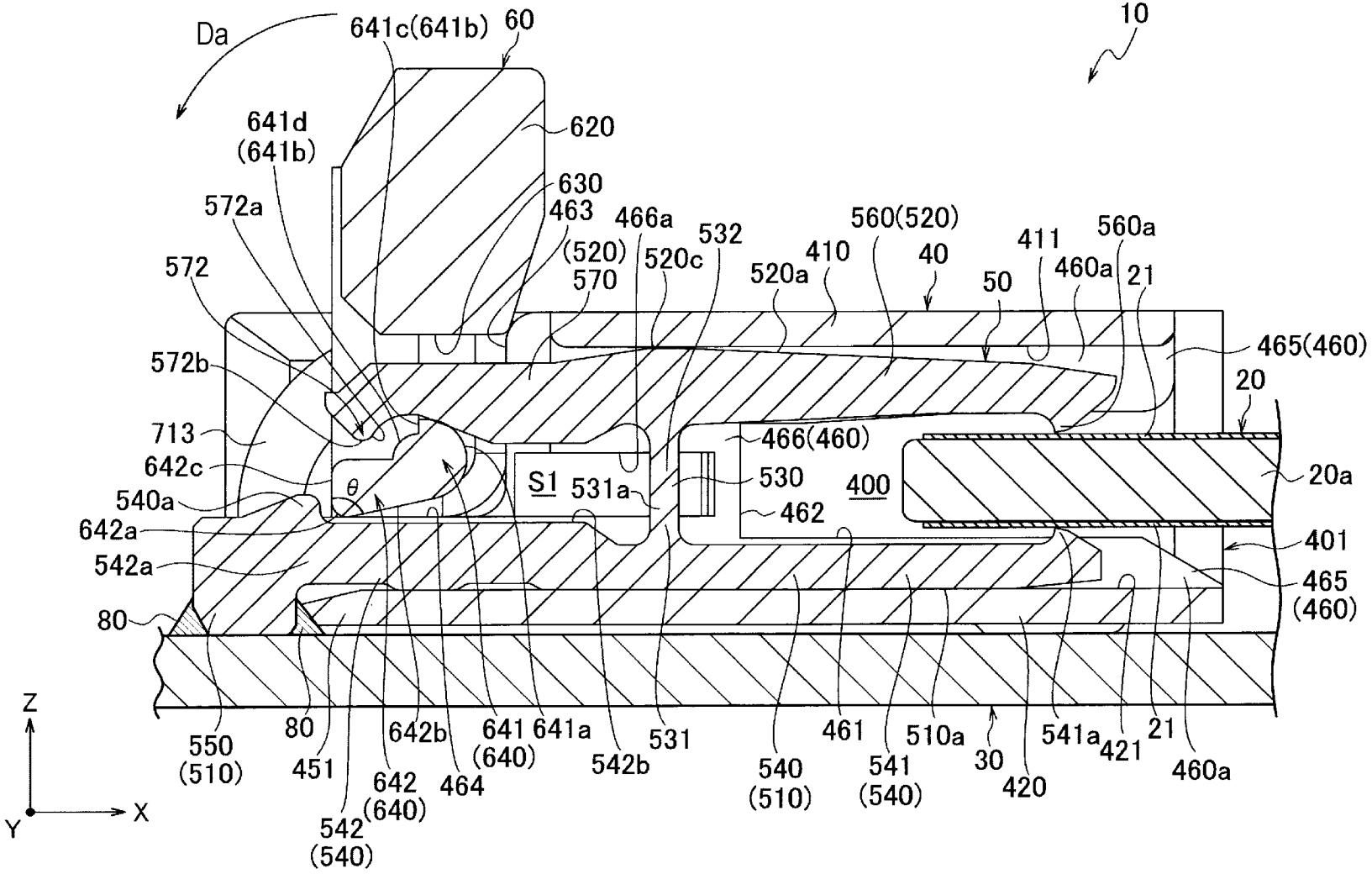
FIG. 3 is a side cross-sectional view of the connector according to Embodiment 1 in which a lever thereof is situated at an open position.
Figure 4:
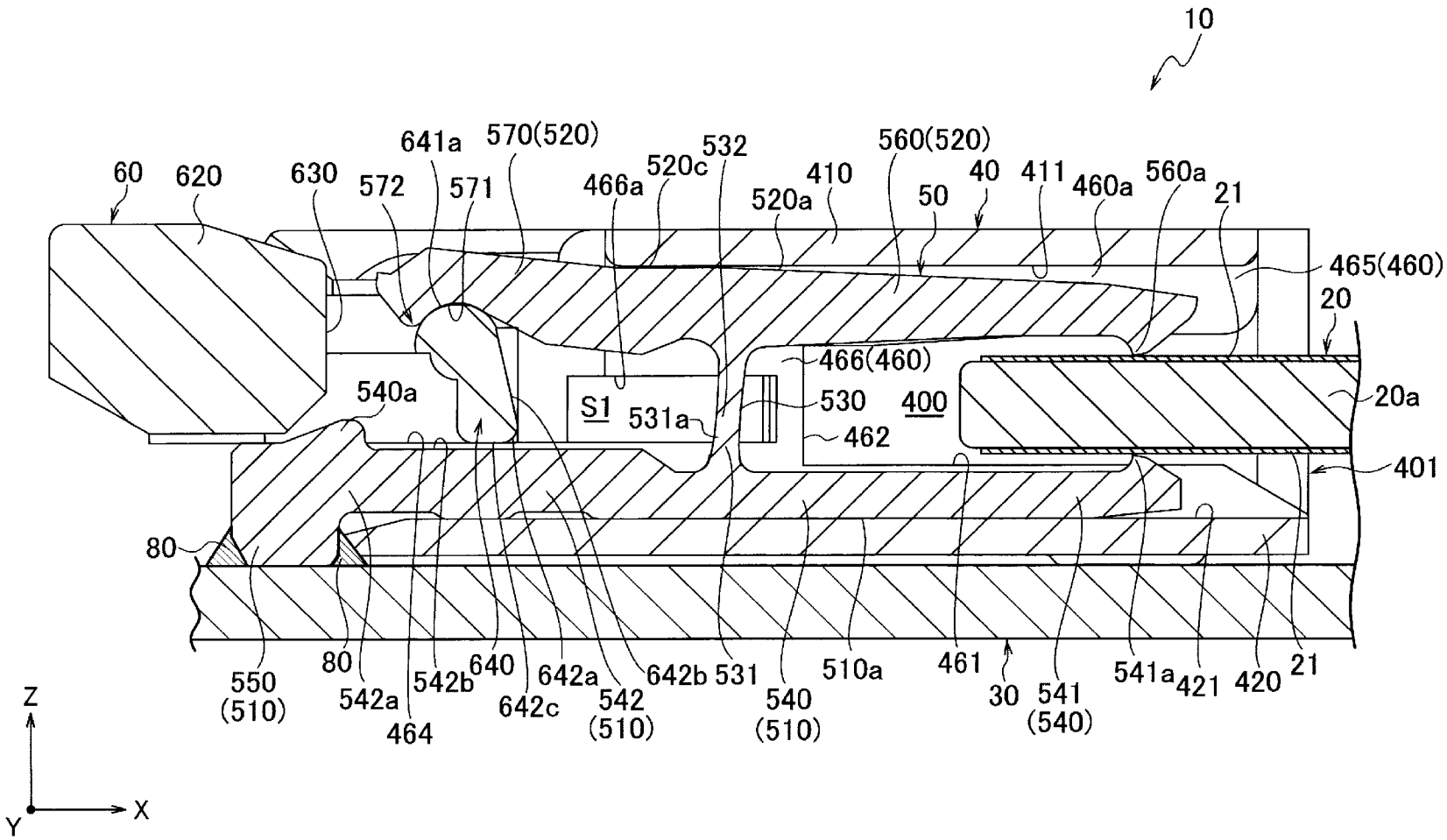
FIG. 4 is a side cross-sectional view of the connector according to Embodiment 1 in which the lever is situated at a closed position.

FIG. 1 is a perspective view of connector 10 according to Exemplary Embodiment 1 of the present invention. FIGS. 2A and 2B are a plan view and a rear view of connector 10, respectively. FIGS. 3 and 4 are side cross-sectional views of connector 10.

As illustrated in FIGS. 1 to 4, connector 10 according to the present embodiment includes insulative housing 40 configured to have cable 20, an object component, be inserted therein. Cable 20 may be an FPC or an FFC, and may have a sheet shape, i.e., a plate shape having an obverse side and a reverse side. Connector 10 further includes contact 50, a terminal, that is accommodated in housing 40 and that is conductively connected to cable 20.

Cable 20 having a sheet shape has insertion end 20*a* connected to a rear end of a main part of the cable. Insertion end 20*a* is configured to be inserted into housing 40. Plural conductors 21 are exposed at insertion end 20*a* at predetermined pitches along the width direction Y (see FIGS. 3 and 4). Plural-conductive contacts 50 which are conductively connected to conductors 21 of cable 20 are arranged inside housing 40 at predetermined pitches along the width direction Y.

Insulative lever 60 is rotatably attached to housing 40.

FIG. 3 shows a state in which lever 60 of connector 10 is situated at an open position. FIG. 4 shows a state in which lever 60 of connector 10 is situated at a closed position. As illustrated in FIGS. 3 and 4, lever 60 is attached to housing 40 such that lever 60 is rotatable between the open position shown in FIG. 3 and the closed position shown in FIG. 4. When lever 60 is situated at the open position, as shown in FIG. 3, cable 20 can be inserted into housing 40. When lever 60 is situated at the closed position, as shown in FIG. 4, cable 20 that is inserted in housing 40 is clamped by contacts 50.

Housing 40 is made of an insulating material, such as synthetic resin. In a front portion of housing 40 along the front-rear direction X, cable receptacle part 400 having a pouch shape configured to have cable 20 be inserted from the front is formed substantially at a middle part of housing 40 along the up-down direction Z. The front portion of housing 40 along the front-rear direction X is on the right side on FIGS. 3 and 4 which is the side from which cable 20 is removed from housing 40.

Cable receptacle part 400 has a laterally-spread flat rectangular shape, and opens toward the front. Specifically, cable receptacle part 400 is demarcated by lower surface 411 of top wall 410, upper surface 421 of bottom wall 420, inner side surfaces 431 of opposite side walls 430 provided at opposite ends of housing 40 along the width direction Y, and front inner surface 441 of rear wall 440 that is connected to the rear ends of opposite side walls 430. Thus, in accordance with the embodiment, cable receptacle part 400 has a pouch shape having insertion opening 401 opening toward the front. Insertion opening 401 has top-to-bottom and left-to-right dimensions corresponding to the thickness and width of cable having a sheet shape (plate shape).

In housing 40, the top and bottom of cable receptacle part 400 are defined by top wall 410 and bottom wall 420, and opposite ends of cable receptacle part 400 may be defined by side walls formed of a member, such as a metal plate or a resin plate, separated from housing 40.

Figure 9:
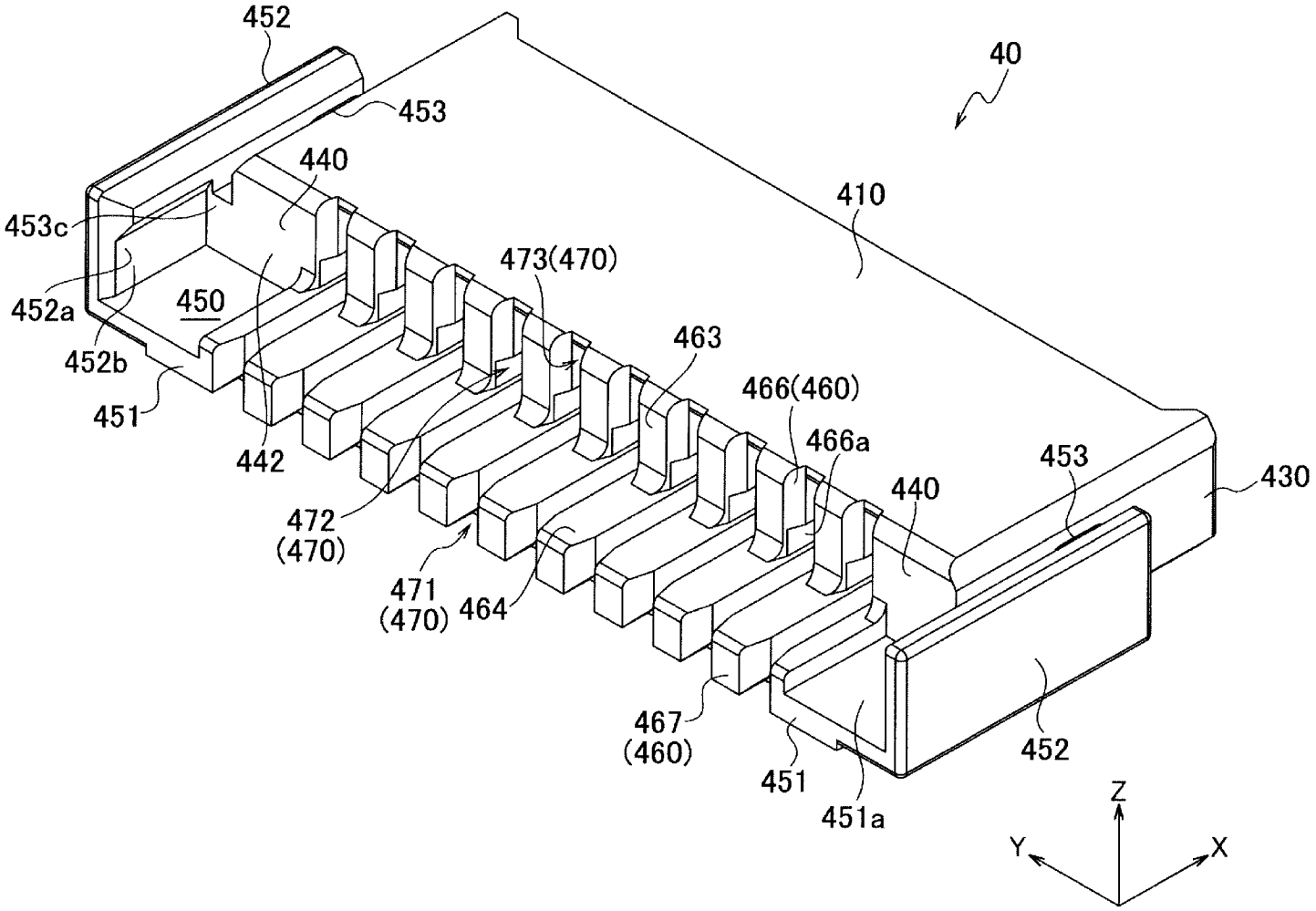
FIG. 9 is a perspective view of a housing of the connector according to Embodiment 1.
Figure 10A:
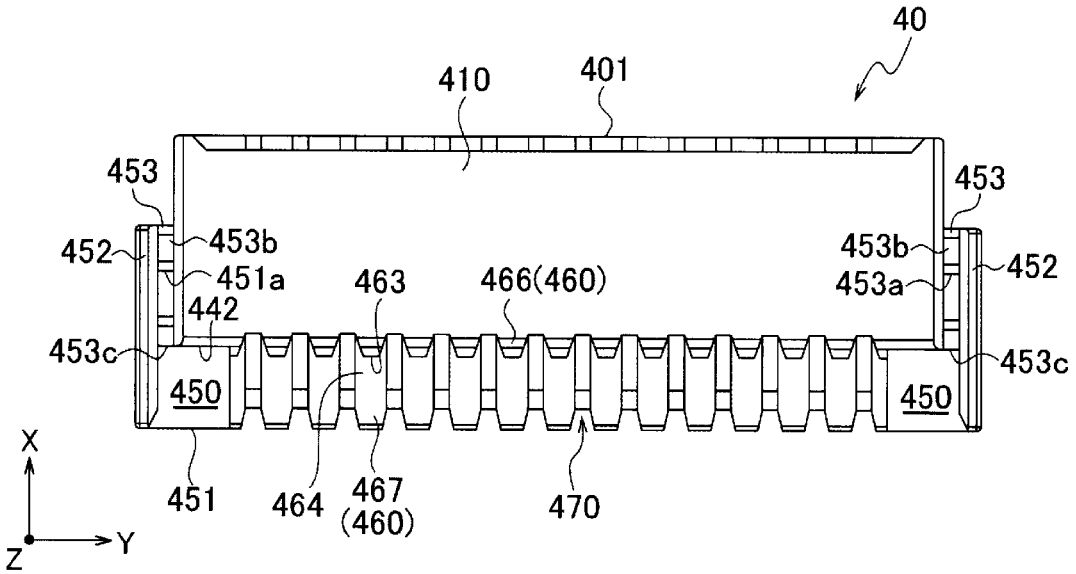
FIGS. 10A, 10B, and 10C are a plan view, a rear view, and a side view of the housing of the connector according to Embodiment 1, respectively.
Figure 10B:
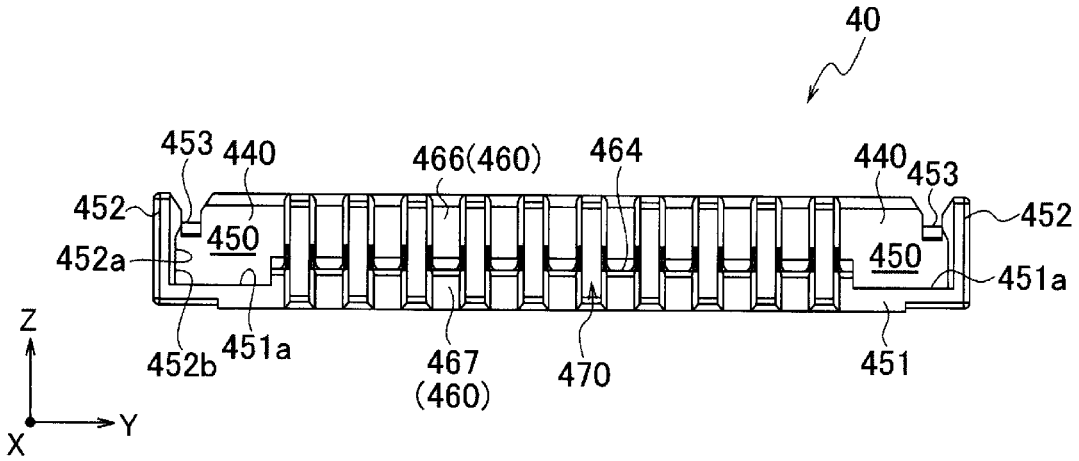
Figure 10C:
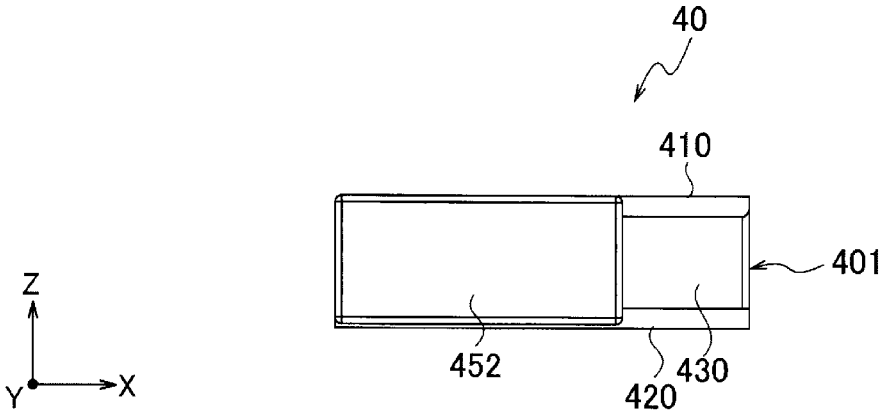
Figure 11:
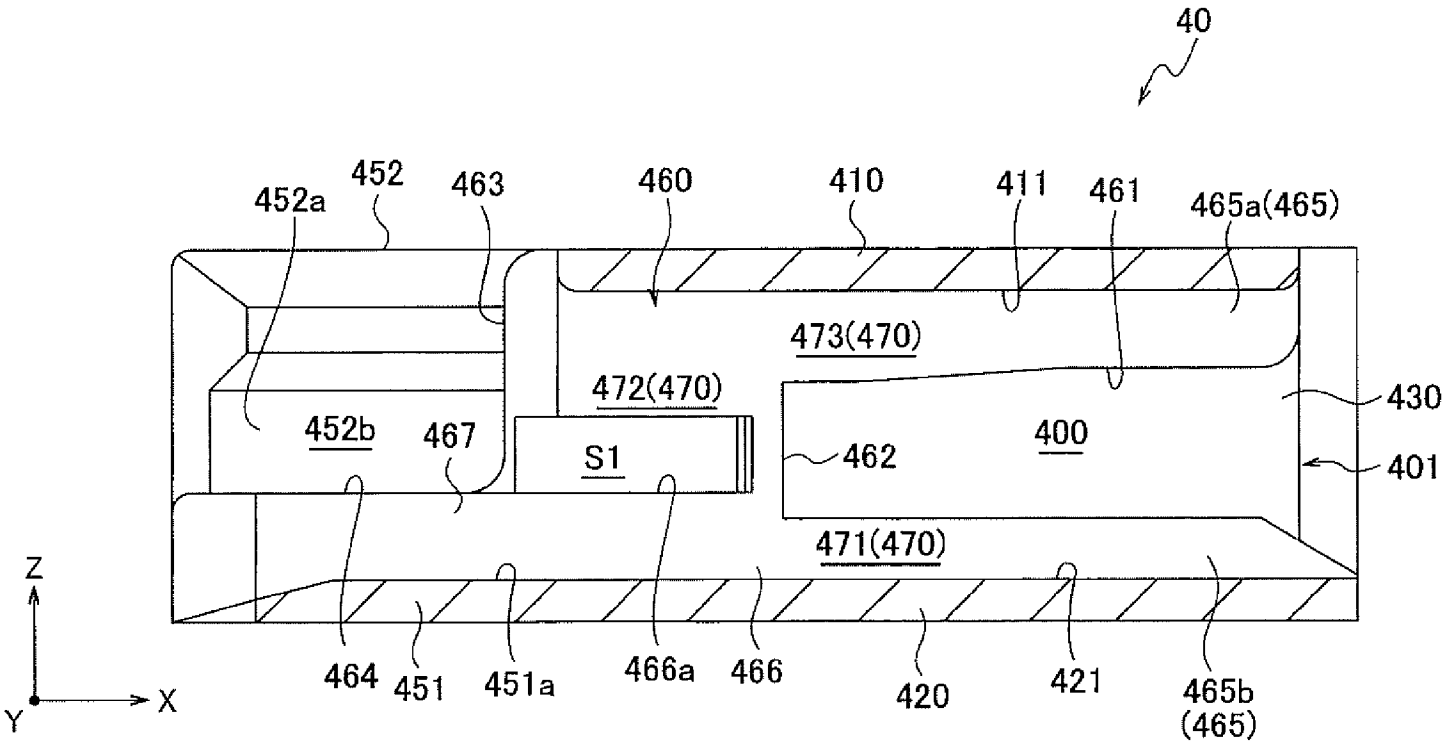
FIG. 11 is a side cross-sectional view of the housing of the connector according to Embodiment 1.

FIG. 9 is a perspective view of housing 40. FIGS. 10A, 10B, and 10C are a plan view, a rear view, and a side view of housing 40, respectively. FIG. 11 is a side cross-sectional view of housing 40.

As illustrated in FIGS. 9 to 11, lever attaching part 450 on which lever 60 is mounted is formed at the rear part of rear wall 440. Lever 60 is rotatably attached to lever attaching part 450.

Lever attaching part 450 includes extension wall 451 extending from a rear portion of bottom wall 420, and a pair of side walls 452 connected to opposite ends of extension wall 451 along the width direction Y. Extension wall 451 extends from the rear portion of bottom wall 420 so as to protrude from rear surface 442 of rear wall 440. Lever 60 is rotatably fitted in a space that opens upward and rearward and that is demarcated by upper surface 451*a* of extension wall 451 and respective inner side surfaces 452*a* of two side walls 452 that face each other.

Lever 60 has a plate shape and can be accommodated in lever attaching part 450 of housing 40. Lever 60 is also made of an insulating material, such as synthetic resin. As illustrated in FIGS. 1, 2A, and 2B, each of pivot shafts 610 is provided on respective one of both sides of one end of lever 60 so as to protrude from the opposite end surfaces of lever 60 along the width direction Y. A main body of lever 60, which is another end of lever 60, functions as operating part 620 for operating lever 60 to cause an open/close operation, i.e., the rotation operation.

In accordance with the present embodiment, opposite ends of extension wall 451 along the width direction Y protrude outward from two opposite side walls 430 that demarcate cable receptacle part 400. The pair of side walls 452 are formed outward relative to opposite side walls 430 along the width direction Y (see FIGS. 9 to 11). Each of side walls 452 overlap a front portion of side wall 452 overlaps side wall 430 along the width direction Y. Side wall 452 is jointed to side wall 430 by joining wall 453.

A pair of recesses 452*b* that face each other in the width direction Y are formed in the pair of side walls 452, respectively. Recesses 452*b* function as bearings.

Figure 5A:
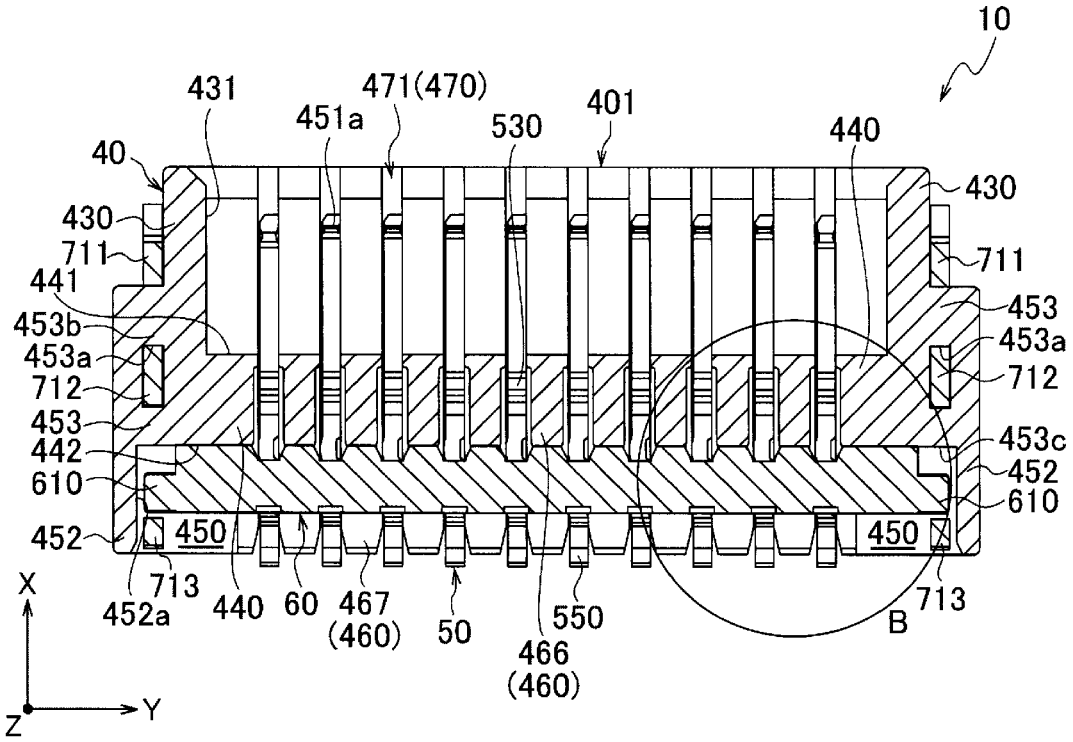
FIG. 5A is a cross-sectional view of the connector along line A-A shown in FIG. 2B.
Figure 5B:
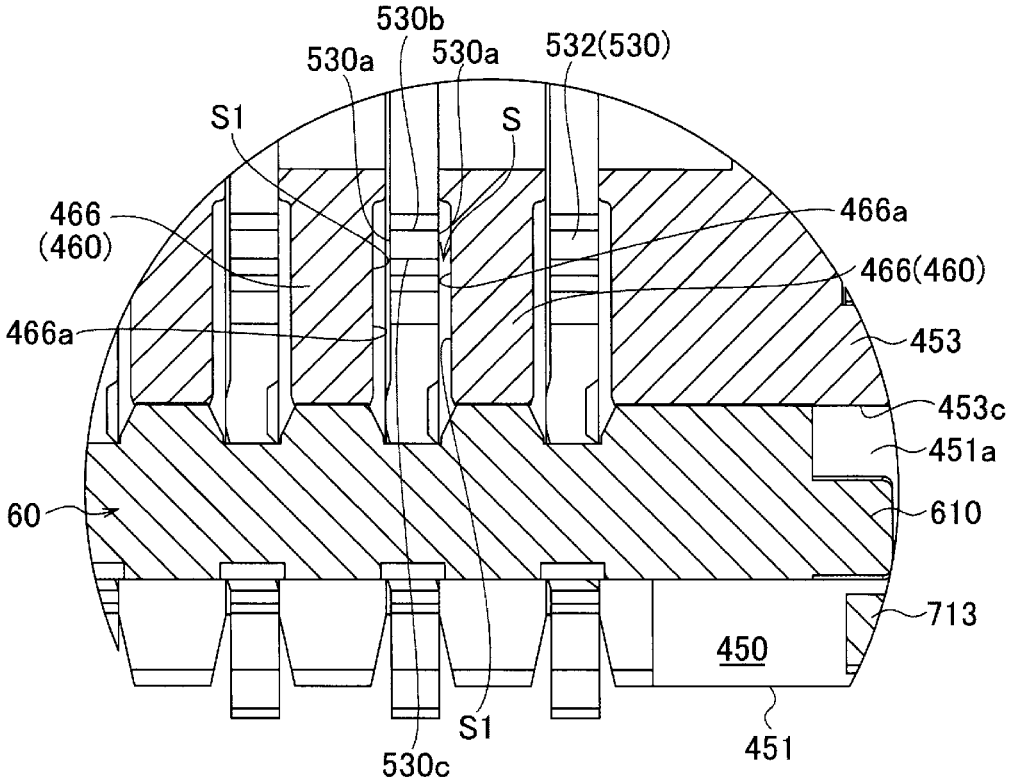
FIG. 5B is an enlarged view of portion B of the connector shown in FIG. 5A.

FIG. 5A is a cross-sectional view of connector 10 along line A-A shown in FIG. 2B. FIG. 5B is an enlarged view of portion B of connector 10 shown in FIG. 5A.

In accordance with the embodiment, pivot shafts 610 on the ends of lever 60 opposite to each other along the width direction Y are inserted from the rear end of housing 40 into recesses 452*b*. The rear end of housing 40 is opposite to cable receptacle part 400 of housing 40. Recesses 452*b* are the bearings provided on the ends of housing 40 opposite to each other along the width direction Y. Each of a pair of retainer brackets 70 is fitted to respective one of two joining walls 453, thereby causing lever 60 to be fitted to lever attaching part 450 of housing 40 so as to be opened and closed, i.e., so as to be rotatable (see FIGS. 1 and 5A).

Figure 6:
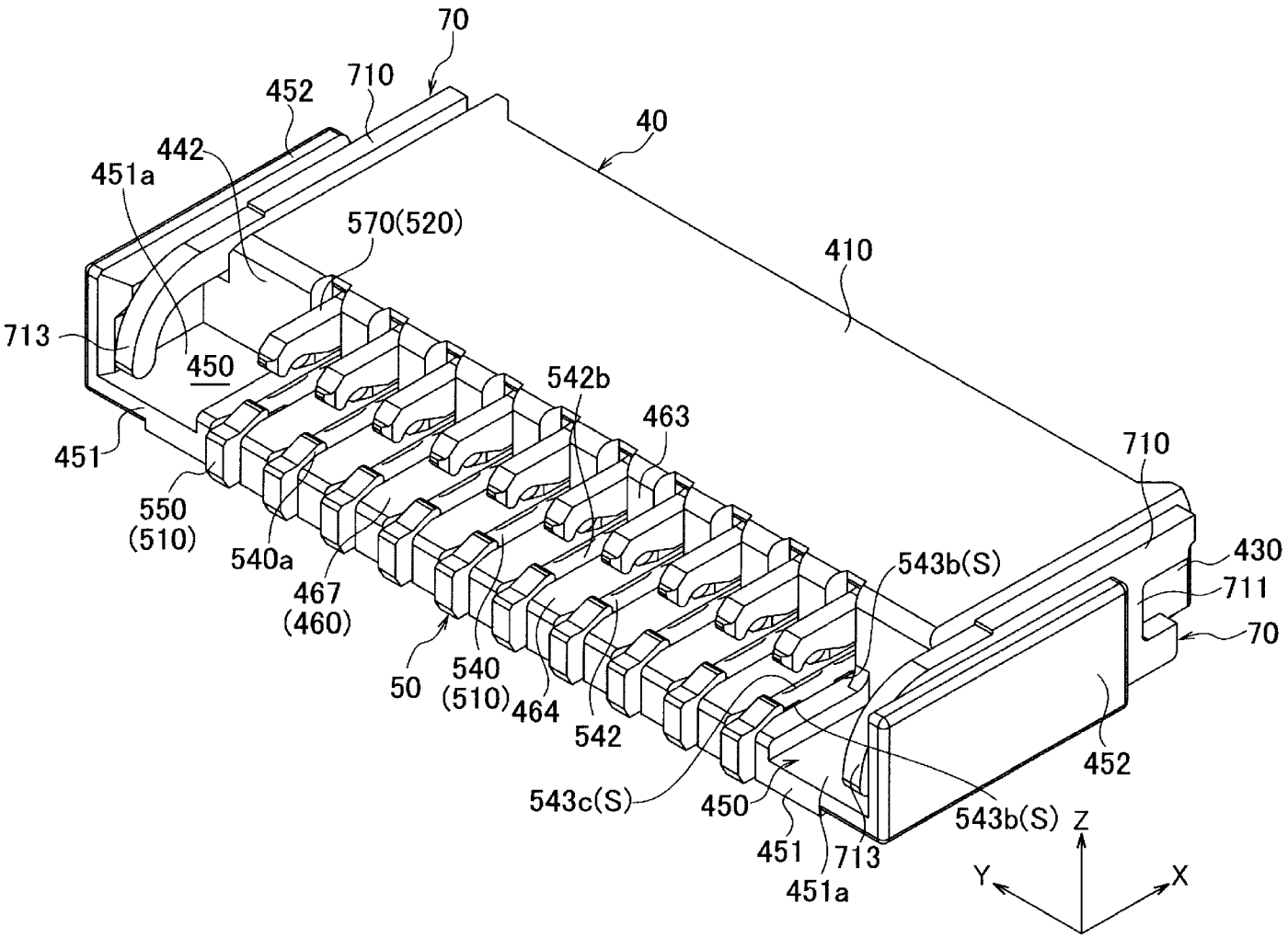
FIG. 6 is a perspective view of the connector according to Embodiment 1 from which the lever is removed.
Figure 7A:
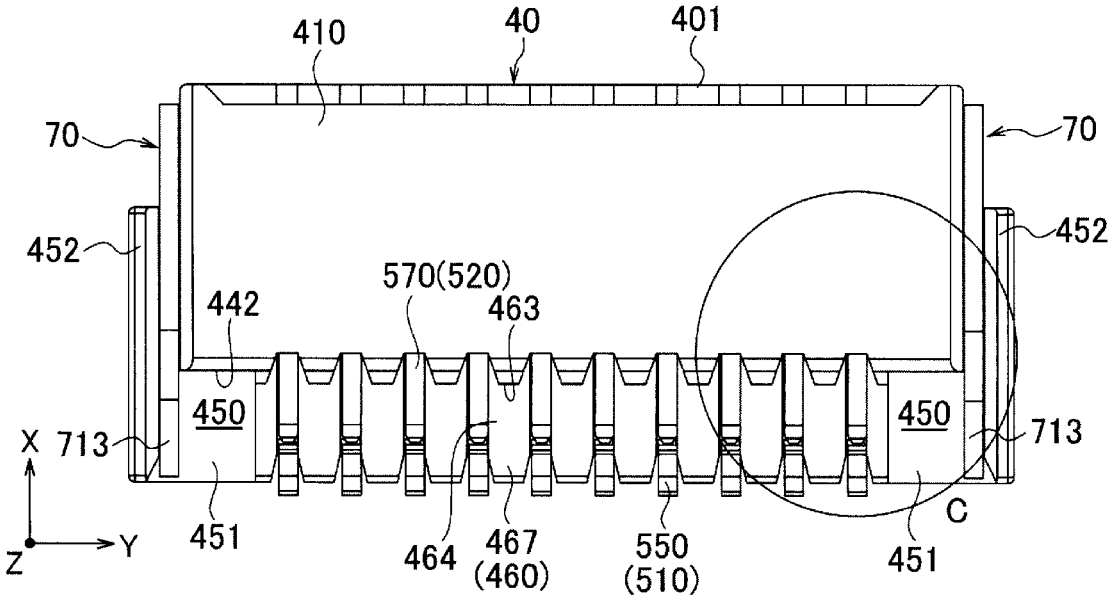
FIGS. 7A, 7B, and 7C are a plan view, a rear view, and a side view of the connector according to Embodiment 1, respectively, from which the lever is removed.
Figure 7B:
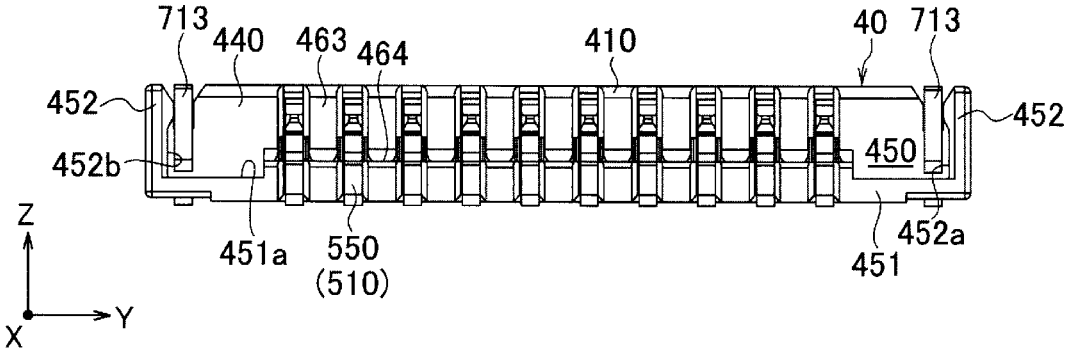
Figure 7C:
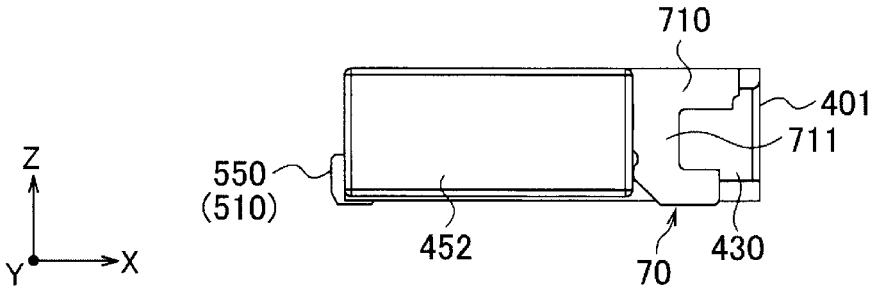
Figure 8:
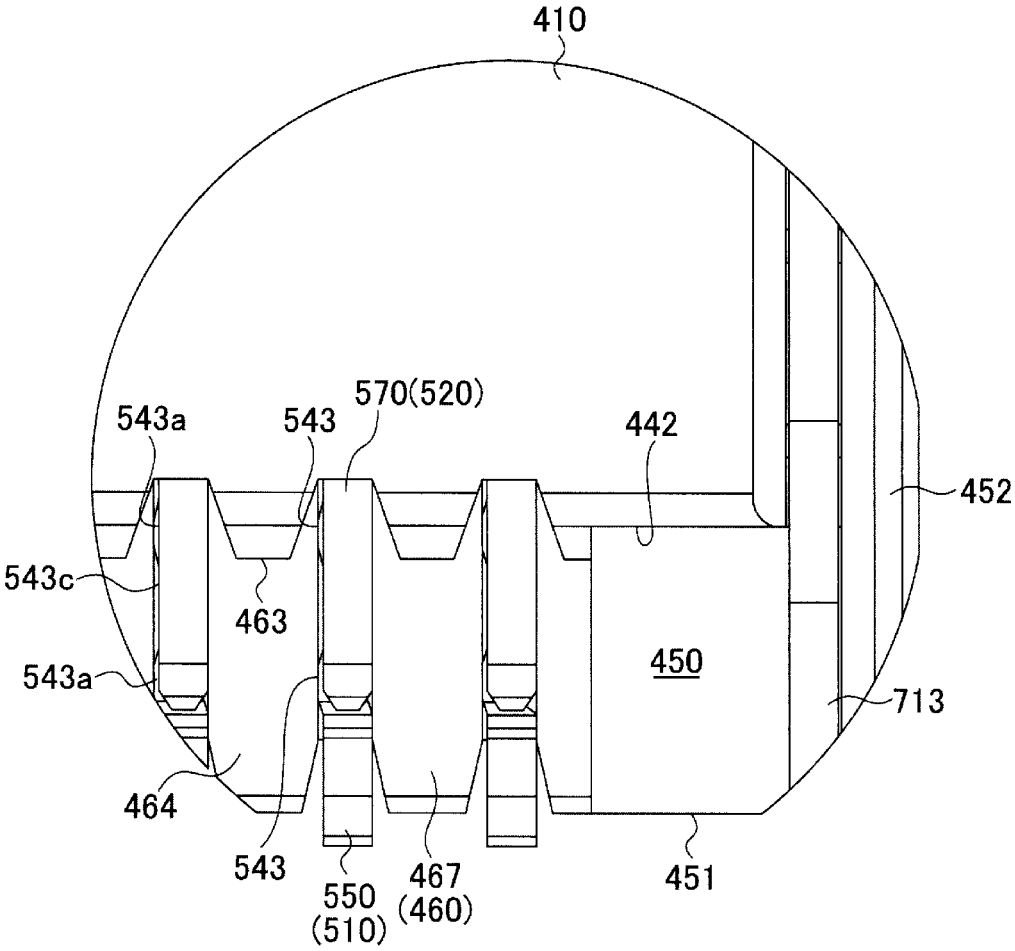
FIG. 8 is an enlarged view of portion C of the connector shown in FIG. 7A.

FIG. 6 is a perspective view of connector 10 from which lever 60 is removed. FIGS. 7A, 7B, and 7C are a plan view, a rear view, and a side view of connector 10 from which lever 60 has been removed, respectively. FIG. 8 is an enlarged view of portion C of connector 10 shown in FIG. 7A.

As illustrated in FIGS. 6 to 8, each of retainer brackets 70 is made of a thin metal plate, and includes main part 710 extending along the front-rear direction X. Support piece 711 extends downwardly from a front portion of main part 710. Insertion piece 712, which is an inserting and securing part, extends downwardly from a portion of main part 710 rearward with respective to support piece 711 of main part 710. Pivot shaft cover 713 having a hook shape curving so as to protrude upwardly extends rearward from insertion piece 712 of main part 710.

While retainer bracket 70 is attached to joining wall 453, pivot shaft cover 713 covers a top portion and a rear portion of pivot shaft 610. Herein, the term "rearward" means a direction in which cable 20 is inserted into housing 40.

Specifically, each joining wall 453 has insertion hole 453*a* provided therein. Insertion hole 453*a* is a recess in which insertion piece 712 is inserted. By press-fitting and inserting insertion pieces 712, which are inserting and securing parts, into insertion holes 453*a* from above, retainer brackets 70 are fitted to joining wall 453 (see FIG. 5A).

In accordance with the present embodiment, front wall portions 453*b* of joining walls 453 are clamped by insertion pieces 712 and support pieces 711. Thus, by clamping front wall portions 453*b* by insertion pieces 712 and support pieces 711, retainer brackets 70 are prevented from being disengaged.

In accordance with the present embodiment, as illustrated in FIGS. 1, 2A, and 2B, retainer brackets 70 are attached to two joining walls 453, whereby the outer circumferences of pivot shafts 610 are covered by pivot shaft covers 713, rear surfaces 453*c* of joining walls 453, and upper surfaces 451*a* of extension walls 451.

Therefore, upward and rearward movements of pivot shafts 610 are restricted by pivot shaft covers 713. A frontward movement of pivot shafts 610 is restricted by rear surfaces 453*c* of joining walls 453. A downward movement of pivot shafts 610 is restricted by upper surfaces 451*a* of extension walls 451. That is, when pivot shafts 610 move upward, or rearward, from which cable 20 is inserted, such movements of pivot shafts 610 are restricted by retainer brackets 70. Thereby, lever 60 is prevented from being disengaged from housing 40.

As described later, lever 60 is also fitted to contacts 50. Retainer brackets 70 and housing 40 restrict movements of pivot shafts 610 in the front-rear direction and the up-down direction, and thereby, prevent lever 60 from being disengaged from housing 40. Thus, the connector in accordance with the present embodiment does not require that lever 60 is engaged with both retainer brackets 70 and contacts 50 in order to prevent lever 60 from being disengaged from housing 40. Rather, the connector in accordance with the present embodiment prevents lever 60 from being disengaged from housing 40 only with retainer brackets 70.

In accordance with the present embodiment, pivot shaft cover 713 curves with a radius of curvature that is greater than the diameter of pivot shaft 610 so that a gap may be formed between pivot shaft cover 713 and pivot shaft 610 while retainer bracket 70 is attached to joining wall 453. That is, in accordance with the present embodiment, retainer bracket 70 is attached to joining wall 453 so that pivot shaft cover 713 can cover a top portion and a rear portion of pivot shaft 610 (i.e., toward the end in which cable 20 is inserted) while pivot shaft cover 713 does not contact pivot shaft 610. This configuration prevents rotation of pivot shaft 610 from being obstructed, and allows pivot shaft 610 to rotate smoothly. As a result, it is unnecessary to carry out high-precision dimension management, such as a cutting process for ensuring rotation of pivot shaft 610.

By covering pivot shaft 610 in the non-contact condition, pivot shaft 610 is accommodated rotatably and slidably in recess 452*b*, the bearing.

In accordance with the present embodiment, lever 60 is attached to housing 40 rotatably from the open position shown in FIG. 3 to the closed position shown in FIG. 4, as described above.

When lever 60 is situated at the open position, lever 60 rises from lever attaching parts 450 of housing 40 into an upright posture, and opens substantially the rear half of lever attaching part 450 above housing 40 (see FIG. 3). At this time, cable 20 can be inserted into cable receptacle part 400 of housing 40.

On the other hand, when lever 60 is situated at the closed position, lever 60 is brought in substantially a horizontal posture and accommodated in lever attaching parts 450 of housing 40. In this condition, cable 20 inserted in cable receptacle part 400 is clamped by contacts 50 (see FIG. 4).

Plural contacts 50 are arranged along the width direction Y of housing 40. Contacts 50 may be formed by, e.g. die-cutting thin metal plates.

Contacts 50 are inserted into housing 40 from the rear to be secured and retained in housing 40 (see FIGS. 3 and 4). In accordance with the present embodiment, accommodation slots 470 accommodating contacts 50 penetrate housing 40 along the front-rear direction X, and the opposite sides of accommodation slots 470 along the width direction Y are separated by vertical walls 460 extending along the front-rear direction X (see FIGS. 9 to 11). In other words, in accordance with the embodiment, each of accommodation slots 470 is surrounded by top wall 410, bottom wall 420, and vertical walls 460, and penetrates housing 40 along the front-rear direction X. Each of accommodation slots 470 is configured so that one contact 50 is inserted therein from the rear. Thus, in accordance with the present embodiment, plural accommodation slots 470 are formed in housing 40. In each of accommodation slots 470, the four sides excluding the front and the rear of which are demarcated by lower surface 411 of top wall 410, the upper surface of bottom wall 420, and opposing side surfaces 460*a* of vertical walls 460 that are adjacent to each other.

As illustrated in FIG. 11, cut-out 461 that opens frontward is formed in a front portion of vertical wall 460 prevents vertical wall 460 from obstructing insertion of sheet-shaped cable 20 into cable receptacle part 400. The movement of cable 20 in a rearward direction, i.e., in an insertion direction, is restricted by inner wall 462, which is formed in an inner portion that is at the rear side of cut-out 461 along the front-rear direction X.

A rear portion of vertical wall 460 has a shape that is cut away to have an L-shape. Rear surface 463 and rear upper surface 464 of vertical wall 460 define lever attaching part 450. Thus, in accordance with the present embodiment, the rear portion of vertical wall 460 constitutes a portion of the above-described extension wall 451.

In accordance with the present embodiment, rear upper surface 464 of vertical wall 460 is located slightly above upper surface 451*a* of extension wall 451.

Thus, in accordance with the present embodiment, vertical wall 460 includes front vertical wall portion 465 connected to top wall 410 and bottom wall 420, central vertical wall portion 466 connected to the rear end of front vertical wall portion 465, and rear vertical wall portion 467 connected to bottom wall 420. Cut-out 461 is formed in a center of front vertical wall portion 465. Central vertical wall portion 466 joins top wall 410 to bottom wall 420. Lever attaching part 450 is located above rear vertical wall portion 467. Front vertical wall portion 465 includes front upper wall portion 465*a* connected to top wall 410 and front lower wall portion 465*b* connected to bottom wall 420. The rear end of front upper wall portion 465*a* is connected to the upper end of central vertical wall portion 466. The rear end of front lower wall portion 465*b* is connected to the lower end of central vertical wall portion 466.

FIGS. 12A, 12B, 12C, 12D, and 12E are a perspective view, another perspective view, a side view, another side view, and a front view of contact 50, respectively.

As illustrated in FIGS. 3 and 12A to 12E, contact 50 has substantially an H-shape. More specifically, contact 50 includes stationary-side contact part 510, which is a stationary-side base part, located near bottom wall 420, and movable-side contact part 520, which is a movable-side base part, located near top wall 410. Stationary-side contact part 510 has a rod shape extending along the front-rear direction X. Movable-side contact part 520 has a rod shape extending along the front-rear direction X, and faces stationary-side contact part 510 in the up-down direction Z, in other words, in the thickness direction of housing 40, or in the thickness direction of cable 20. A middle portion of stationary-side contact part 510 along the front-rear direction X (a lengthwise direction) and a middle portion of movable-side contact part 520 along the front-rear direction X are joined to each other with joint spring part 530, which is a joint part, so that movable-side contact part 520 can move relative to stationary-side contact part 510. In accordance with the present embodiment, movable-side contact part 520 may move relative to stationary-side contact part 510 along an XZ plane which extends along the front-rear direction X and the up-down direction Z. Joint spring part 530 has much more flexible than stationary-side contact part 510 and movable-side contact part 520. In other words, stationary-side contact part 510 and movable-side contact part 520 deform much less easily than joint spring part 530.

Stationary-side contact part 510, movable-side contact part 520, and joint spring part 530 are joined so as to form substantially an H-shape. Substantially H-shaped contact 50 is accommodated in accommodation slot 470 formed in housing 40.

Specifically, lower groove 471 is formed under accommodation slot 470. The three sides of lower groove 471, the lower side and opposing sides, are defined by bottom wall 420 and extension wall 451, front lower wall portions 465*b* that are adjacent to each other, lower parts of central vertical wall portions 466 that are adjacent to each other, and rear vertical wall portions 467 that are adjacent to each other. Stationary-side contact part 510 is inserted in lower groove 471.

Central groove 472 is formed in a central portion of each of accommodation slots 470. The opposite sides of central groove 472 that face each other are defined by the central portions of central vertical wall portions 466 that are adjacent to each other. Joint spring part 530 is inserted into central groove 472.

Upper groove 473 is formed above accommodation slot 470. The three sides of upper groove 473, the top side and the opposite sides, are defined by top wall 410 and top parts of central vertical wall portions 466 that face each other. Movable-side contact part 520 is inserted in upper groove 473.

In accordance with the present embodiment, while contacts 50 are accommodated in accommodation slots 470 of housing 40, lower surface 50*a* of contact 50, that is, lower surface 510*a* of stationary-side contact part 510, faces upper surface 421 of bottom wall 420 and upper surface 451*a* of extension wall 451. Upper surface 50*b* of contact 50, that is, upper surface 520*a* of movable-side contact part 520, faces lower surface 411 of top wall 410. Side surfaces 50*c* of contact 50, that is, side surface 510*b* of stationary-side contact part 510, side surface 530*a* of joint spring part 530, and side surface 520*b* of movable-side contact part 520, face side surface 460*a* of vertical wall 460 across very small gaps.

In accordance with the present embodiment, stationary-side contact part 510 includes stationary-side base body 540. Stationary-side base body 540 is accommodated in accommodation slot 470 formed in housing 40 such that relative movement of stationary-side base body 540 relative to housing 40 is restricted.

More specifically, stationary-side base body 540 includes press-fitting portion 543. Stationary-side base body 540 is press-fitted into lower groove 471 so as to prevent stationary-side base body 540 from moving relative to housing 40.

In accordance with the present embodiment, press-fitting portion 543 includes projections 543*a* provided on a side portion of the rear end of stationary-side base body 540. Projections 543*a* protrude in the width direction Y. Projections 543*a* protrude along the entirety of stationary-side base body 540 from the bottom end to the top end protrudes in the width direction Y. Projections 543*a* can be formed by pressing one of the sides of stationary-side base body 540 toward the other side thereof by, for example, a pressing process. When projections 543*a* are formed by thus pressing one of the sides of stationary-side base body 540 toward the other side thereof, recess 543*b* is accordingly formed at a location of stationary-side base body 540 that corresponds to projections 543*a*. In the accordance with present embodiment, two (plural) projections 543*a* are arranged along the front-rear direction X so as to be spaced apart along the front-rear direction X. This configuration causes recess 543*c* to be formed between two projections 543*a* of stationary-side base body 540.

Thus, in accordance with the present embodiment, in a region near terminal part 550 which is the mount portion of stationary-side contact part 510 which is the base part, plural recesses, specifically, two recesses 543*b* and one recess 543*c* are formed along the front-rear direction X which is an extending direction in which stationary-side contact part 510 extends. In accordance with the present embodiment, the plural recesses, specifically, two recesses 543*b* and one recess 543*c* are arranged alternately in one side and the other side along the width direction Y which crosses the front-rear direction X. As illustrated in FIG. 6, recess 543*b* disposed in one side along the width direction Y (the right side in FIG. 6), recess 543*c* disposed in the other side (the left side in FIG. 6), and recess 543*b* disposed in the one side (the right side in FIG. 6) are formed in that order from the rear along the front-rear direction X.

Protruding portion 540*a* having substantially a ridge shape that protrudes upward beyond rear upper surface 464 of vertical wall 460 is provided at the rear end of stationary-side base body 540. When lever 60 situated at the open position is translated to the rear along the front-rear direction X, lever 60 contacts protruding portion 540*a*. Thus, in accordance with the present embodiment, protruding portion 540*a* has a function as a stop that prevents lever 60 from being disengaged.

A punching process or a pressing process to form contact 50 into the above-described shape may not necessarily required to fabricate contact 50 having the above shape, but it is also possible use mold or the like to fabricate contact 50 having the above shape.

In accordance with the present embodiment, stationary-side base body 540 includes stationary-side arm part 541 and terminal arm part 542. Stationary-side arm part 541 extends along bottom wall 420 and exists in a front region along the front-rear direction X, i.e., one end portion, of stationary-side contact part 510. Terminal arm part 542 extends along bottom wall 420 and exists in a rear portion along the front-rear direction X, i.e., the other end portion, of stationary-side contact part 510.

In addition, stationary-side contact portion 541*a* protruding upward toward the inserted cable 20 is formed at the tip end portion of stationary-side arm part 541. In accordance with the present embodiment, most of stationary-side arm part 541 is accommodated inside lower groove 471, and the tip end (upper end) of stationary-side contact portion 541*a* is exposed inside cable receptacle part 400 (i.e., outside of lower groove 471) (see FIGS. 3 and 4). Accordingly, stationary-side contact portion 541*a* can contact conductor 21 of cable 20.

Terminal part 550, which is a mount portion, is connected to tip end portion 542*a*, which is a mount portion-side end of terminal arm part 542. Terminal part 550 is mounted onto circuit board 30, which is an object device, with mount agent 80, such as solder or flux. Terminal part 550 protrudes downward slightly outside the bottom wall 420 of housing 40. This configuration allows terminal part 550 to function as a stop that restricting the maximum insertion amount by which contact 50 is inserted into housing 40 when contact 50 is inserted in accommodation slot 470.

In accordance with the present embodiment, while contact 50 is press-fitted in accommodation slot 470 of housing 40, upper surface 542*b* of terminal arm part 542 is located below rear upper surface 464 of vertical wall 460. In other words, in accordance with the present embodiment, most of terminal arm part 542 is accommodated inside lower groove 471. The portion of terminal arm part 542 that corresponds to protruding portion 540*a* is exposed inside lever attaching part 450, in other words, outside lower groove 471. In addition, the rear end and the lower end of terminal part 550 are exposed outside lower groove 471.

On the other hand, movable-side contact part 520, which is a movable-side base part, includes movable-side arm part 560 and spring part 570, as illustrated in FIGS. 3 and 12A to 12E. Movable-side arm part 560 extends along top wall 410 and exists in a front region along the front-rear direction X, i.e., one end portion, of movable-side contact part 520. Spring part 570 extends along top wall 410 and exists in a rear region along the front-rear direction X, i.e., the other end portion, of movable-side contact part 520. Movable-side contact part 520 includes protruding portion 520*c* at an upper central portion of movable-side contact part 520.

In addition, movable-side contact portion 560*a* protruding downward toward the inserted cable 20 is formed at the tip end portion of movable-side arm part 560. In accordance with the present embodiment, most of movable-side arm part 560 is accommodated inside upper groove 473, and the tip end (lower end) of movable-side contact portion 560*a* is exposed inside cable receptacle part 400 (i.e., outside of upper groove 473) (see FIGS. 3 and 4). Accordingly, movable-side contact portion 560*a* can contact conductor 21 of cable 20.

In accordance with the present embodiment, when lever 60 is situated at the open position, the distance between stationary-side contact portion 541*a* and movable-side contact portion 560*a* is substantially equal to the thickness of cable 20 (see FIG. 3). On the other hand, when cable 20 is not inserted and lever 60 is situated at the closed position, the distance between stationary-side contact portion 541*a* and movable-side contact portion 560*a* is smaller than the thickness of cable 20. Accordingly, when lever 60 is situated at the open position, cable 20 can be inserted into housing 40. When lever 60 is situated at the closed position, stationary-side contact portion 541*a* and movable-side contact portion 560*a* press and contact cable 20, thereby causing contacts 50 to clamp cable 20.

The front side portion of spring part 570 is accommodated in upper groove 473, and the rear side portion of spring part 570 is exposed inside lever attaching part 450, i.e., outside upper groove 473. Cam surface 571 having substantially an arcuate shape is formed on the lower surface of a portion of spring part 570 that is exposed in lever attaching part 450, i.e., outside upper groove 473 is cam surface 571 having substantially an arcuate shape. Cam surface 571 slidably contacts cam part 640 of lever 60. Engaging projection 572 connected to cam surface 571 is formed at the rear of cam surface 571. Engaging projection 572 is a part of a projection and a recess that engage with each other.

Joint spring part 530 has a spring property elastically deforming. In accordance with the present embodiment, joint spring part 530 includes root portion 531 and displaceable portion 532. Root portion 531 is joined to stationary-side base body 540. Displaceable portion 532 is connected to root portion 531 and is displaced relative to root portion 531.

Since contact 50 has the shape as described above, joint spring part 530 elastically deforms when spring part 570 is displaced in a direction in which the rear end of spring part 570 and the rear end of terminal arm part 542 open relatively. More specifically, joint spring part 530 elastically deforms due to a flexural deformation of displaceable portion 532 and a rotation of displaceable portion 532 relative to root portion 531. The elastic deformation of joint spring part 530 decreases the gap between movable-side arm part 560 of movable-side contact part 520 and stationary-side arm part 541 of stationary-side contact part 510.

As illustrated in FIGS. 1, 2A, and 2B, through-hole 630 corresponding to spring part 570 of contact 50 in one end portion of lever 60. Cam part 640 is formed at a position of lever 60 that is adjacent to through-hole 630 (see FIGS. 3 and 4). Cam part 640 rotates according to the rotation of lever 60 to slidably contact cam surface 571 provided on spring part 570.

In accordance with the present embodiment, cam part 640 includes round portion 641 and rectangular portion 642 connected to circular portion 641. Round portion 641 has a substantially columnar shape. Rectangular portion 642 has substantially a rectangular parallelepiped shape. Cam part 640 has substantially a keyhole shape viewing in cross section along the front-rear direction X.

Round portion 641 of cam part 640 has contact surface 641*a* contacting cam surface 571 of spring part 570 of contact 50 slidably according to the rotation of lever 60. In accordance with the present embodiment, the arcuate surface that is a side surface of round portion 641 having substantially a circular columnar shape serves as contact surface 641*a*.

Rectangular portion 642 of cam part 640 has pivot bearing surface 642*a*, which is a rotation bearing portion. Pivot bearing surface 642*a* slidably contacts rear upper surface 464 of vertical wall 460, and serves as a pivot point when lever 60 rotates in opening and closing directions.

Rectangular portion 642 of cam part 640 further has surfaces 642*b* and 642*c*. Surface 642*b* contacts rear upper surface 464 of vertical wall 460 when lever 60 is situated at a fully open state. Surface 642*c* contacts rear upper surface 464 of vertical wall 460 when lever 60 is situated into a fully closed state. Angle θ (see FIG. 3) formed by surface 642*b* and surface 642*c* is an acute angle. Pivot bearing surface 642*a* of cam part 640 is provided between surfaces 642*b* and 642*c*. Pivot bearing surface 642*a* has an arcuate surface with a small radius of curvature.

In accordance with the present embodiment, as illustrated in FIG. 3, when lever 60 is situated at the open position, cam part 640 has an elongated shape slenderly extending along a lateral direction, i.e., along the front-rear direction X, so that the dimension of cam part 640 along the up-down direction Z is smaller than the gap between spring part 570 and terminal arm part 542 of contact 50. That is, when lever 60 is situated at the open position, cam part 640 and spring part 570 are in a non-contact state. i.e. do not contact each other.

While lever 60 rotates in closing direction Da (see FIG. 3), the dimension of cam part 640 along the up-down direction Z becomes greater than the gap between spring part 570 and terminal arm part 542 while cam part 640 rotates so as to stand upright.

That is, while lever 60 rotates in closing direction Da, cam part 640 rotates about pivot bearing surface 642*a* serving as the pivot point according to the rotation of lever 60. While lever 60 rotates in closing direction Da, contact surface 641*a* contacts cam surface 571 of spring part 570 so as to slide on and contact cam surface 571.

As lever 60 rotates further in closing direction Da, cam part 640 rotates while contact surface 641*a* slides and contacts cam surface 571, causing spring part 570 to elastically deform so as to increase the gap between the tip end of spring part 570 and the tip end of terminal arm part 542. In association with the displacement of spring part 570, joint spring part 530 elastically deforms, in other words, joint spring part 530 deforms due to the deflection of displaceable portion 532 or rotates relative to root portion 531 of displaceable portion 532. As a result, contact 50 elastically deforms so as to decrease the gap between movable-side arm part 560 of movable-side contact part 520 and stationary-side arm part 541 of stationary-side contact part 510.

This configuration moves movable-side contact portion 560*a* toward stationary-side contact portion 541*a*. Consequently, movable-side contact portion 560*a* and stationary-side contact portion 541*a* press and contact cable 20, thereby conductively connecting cable 20 with contact 50. Thus, cam part 640 is configured to apply a pressing force to contact 50 for causing contact 50 to press and contact cable 20.

In accordance with the present embodiment, while lever 60 rotates in closing direction Da from the open position to the closed position, the height of cam part 640 gradually increases until reaching a certain point. When lever 60 rotates over a predetermined rotation amount, the height of cam part 640 gradually decreases. The direction of the moment acting on lever 60 that results from cam part 640 pressed by the elastic restoration force of spring part 570 changes from the opening direction to the closing direction at the middle of rotating lever 60 from the open position to the closed position.

By reducing the radius of cam part 640 in the middle of rotating lever 60, or by changing the direction of the moment acting on lever 60 from the opening direction to the closing direction in the middle of rotating lever 60, click feel is provided in operating lever 60.

In accordance with the present embodiment, pivot bearing surface 642*a* (pivot bearing part) of cam part 640 is formed such that angle θ formed by surface 642*b* contacting rear upper surface 464 of vertical wall 460 in the open state of lever 60, and surface 642*c* contacting rear upper surface 464 of vertical wall 460 in the closed state of lever 60 becomes an acute angle, as described above. This configuration reduces the width of cam part 640, and allows lever 60 to rotate more easily. Since lever 60 can rotate thus easily, when lever 60 rotates over the predetermined rotation amount and the direction of the moment acting on lever 60 changes from the opening direction to the closing direction, the click feel in operating lever 60 is increased as lever 60 can rotate in closing direction Da more quickly.

Pivot bearing surface 642*a*, which is a pivot bearing part, has an arcuate shape that joins surface 642*b* and surface 642*c* together. This configuration allows the lever to operate more smoothly, and prevents pivot bearing surface 642*a* from being abraded due to the operation of lever 60.

When lever 60 rotates in an opening direction changing from closing direction Da, similar click feel is also provided.

In accordance with the present embodiment, as illustrated in FIGS. 3 and 4, round portion 641 of cam part 640 has engaging recess 641*b* therein that engages with engaging projection 572. Engaging recess 641*b* is formed by side surface 641*c* and arcuate surface 641*d*. Side surface 641*c* can contact front end 572*a* of engaging projection 572. Arcuate surface 641*d* can contact tip end 572*b* which is the lower end of engaging projection 572. Front end 572*a* contacts side surface 641*c* while tip end 572*b* contacts arcuate surface 641*d* so as to cause engaging projection 572 to be engaged with engaging recess 641*b*.

The base part (stationary-side contact part 510) includes a base body (stationary-side base body 540) and a mount portion (terminal part 550) connected to the base body (stationary-side base body 540) at connection point 510*p*1. The mount portion (terminal part 550) is configured to be mounted onto the object device (circuit board 30) with mount agent 80. The joint part (joint spring part 530) includes root portion 531 that is joined to the base body (stationary-side base body 540), and displaceable portion 532 that is connected to root portion 531 at connection point 510*p*2. Displaceable portion 532 is displaced relative to root portion 531. Space S that prevents mount agent 80 from moving to displaceable portion 532 is formed around the terminal (contact 50) between connection point 510*p*2 and connection point 510*p*1.

In accordance with the present embodiment, spring part 570 and cam part 640 has engaging projection 572 and engaging recess 641*b*, which are the protrusion and recess that are engaged with each other. Engaging projection 572 and engaging recess 641*b* are not engaged with each other by normal opening and closing operations of lever 60 (see FIGS. 3 and 4).

When a rearward load is placed onto lever 60 in an open state in opening and closing operations of lever 60 or in a non-use state, i.e., a state in which cable 20 is not inserted, lever 60 may move rearward and upward with lever 60 is continuously in the open state, thereby moving in a disengaging direction relative to contact 50. Consequently, lever 60 may move over protruding portion 540*a* having substantially a ridge shape. In this case, engaging projection 572 and engaging recess 641*b* are engaged with each other to prevent lever 60 from being disengaged from housing 40.

This does not mean that lever 60 is prevented from being disengaged from housing 40 in an engaged state. Rather, engaging projection 572 and engaging recess 641*b* are configured to be engaged with each other when an excessive load is placed on lever 60 to cause lever 60 to relatively move in the disengaging direction. This increases reliability in the disengagement prevention effect for lever 60. Engaging projection 572 and engaging recess 641*b* are not merely interlocked but engaged with each other, so that lever 60 can be effectively prevented from being disengaged from housing 40.

Lever 60 with such a configuration may be attached to housing 40 by, e.g. the following process.

First, the rear end of spring part 570 is inserted into through-hole 630 of lever 60, and cam part 640 is inserted between the rear end of spring part 570 and the rear end of terminal arm part 542, i.e., between the tip end 572*b*, which is the lower end, and protruding portion 540*a*.

Then, pivot shafts 610 at the opposite ends of lever 60 along the width direction Y are placed in recesses 452*b*, which are bearing parts at the opposite ends of housing 40 along the width direction Y, and retainer brackets 70 are attached to joining walls 453. Thus, lever 60 is attached rotatably to lever attaching parts 450 of housing 40 while can open and be closed.

In accordance with the present embodiment, when lever 60 is situated at the open position, cam part 640 has an elongated shape slenderly extending along the lateral direction, i.e., along the front-rear direction X. This configuration decreases the thickness of cam part 640 that faces the gap between tip end 572*b* and protruding portion 540*a* when the rear end of spring part 570 is inserted into through-hole 630, i.e., when through-hole 630 is opposed to the rear end of spring part 570. This configuration does not require to press-fit cam part 640 with a large force when cam part 640 is inserted through the gap between tip end 572*b* and protruding portion 540*a*, thus allowing cam part 640 to be inserted easily.

An operation of contact 50 while closing lever 60 is closed will be explained below with reference to FIGS. 3 and 4.

First, as illustrated in FIG. 3, when lever 60 is situated at the open position, the front portion of spring part 570 of movable-side contact part 520 is close to top wall 410 of housing 40, but does not contact top wall 410 of housing 40. In other words, spring part 570 of movable-side contact part 520 is spaced from top wall 410 with a gap in between. At this moment, cam part 640 of lever 60 and cam surface 571 of spring part 570 are in a non-engaged state, i.e., are not engaged with each other.

Next, cable 20 is inserted into housing 40. In accordance with the present embodiment, the distance between stationary-side contact portion 541*a*, which is the tip end of stationary-side arm part 541, and movable-side contact portion 560*a*, which is the tip end of movable-side arm part 560, i.e., the minimum distance along the up-down direction Z in contact 50, is substantially equal to the thickness of cable 20. This configuration suppresses a friction force arising between cable 20 and contacts 50 when inserting cable 20 into housing 40, allowing cable 20 to be inserted into housing 40 smoothly.

Then, when lever 60 rotates in a counterclockwise direction, i.e., closing direction Da, while cable 20 is inserted in housing 40, contact surface 641*a* slides on and contacts cam surface 571 of spring part 570. As lever 60 rotates further in closing direction Da, cam part 640 rotates while contact surface 641*a* slide on and contact cam surface 571, causing spring part 570 to elastically deform so as to increase the gap between the tip end of spring part 570 and the tip end of terminal arm part 542 of contact 50. The center portion of spring part 570 contacts top wall 410 at a middle of the rotating of lever 60 in closing direction Da.

In association with a displacement of spring part 570, joint spring part 530 elastically deforms due to flexural deformation of displaceable portion 532 and a relative rotation of displaceable portion 532 relative to root portion 531. Spring part 570 and joint spring part 530 are thus displaced, to cause contact 50 to elastically deform so as to decrease the gap between movable-side arm part 560 of movable-side contact part 520 and stationary-side arm part 541 of stationary-side contact part 510, i.e., the distance between movable-side contact portion 560*a* and stationary-side contact portion 541*a*. That is, movable-side contact portion 560*a* moves toward stationary-side contact portion 541*a*. As a result, cable 20 is conductively connected to contact 50 with movable-side contact portion 560*a* pressing and contacting stationary-side contact portion 541*a*.

Under the condition in which contact 50 is press-fitted in accommodation slot 470 of housing 40, terminal part 550, which is a mount portion, is mounted onto circuit board 30, which is an object device.

Specifically, terminal part 550 is soldered to circuit board 30 under the condition in which lower surface 50*a*, upper surface 50*b*, and side surfaces 50*c* of contact 50, which are the outer surfaces thereof, face lower surface 411, upper surface 421, and side surface 460*a* of housing 40, which are the inner surfaces thereof, respectively.

At this time, lower surface 50*a* and side surfaces 50*c* of contact 50 face upper surface 421 of bottom wall 420 and side surface 460*a* of vertical wall 460 across very small gaps, respectively. In other words, contact 50 is press-fitted into accommodation slot 470 of housing 40 under the condition in which a very small gap extending continuously from terminal part 550 to displaceable portion 532 of joint spring part 530 is formed around stationary-side contact part 510 and joint spring part 530.

Terminal parts 550 are often soldered to circuit board 30 with flux in addition to solder. Flux may be previously applied to soldering locations before the soldering, or may be mixed with solder.

Terminal parts 550, which are mount portions, are often mounted onto circuit board 30, which is an object device with flux and solder as mount agent 80.

However, if terminal parts 550 are soldered to circuit board 30 with mount agent 80 under the condition where a very small gap is formed continuously from terminal part 550 to displaceable portion 532 of joint spring part 530, a certain component, flux, of mount agent 80 may flow into displaceable portion 532 of joint spring part 530 by a capillary action. The flux flowing into displaceable portion 532 of joint spring part 530 may obstruct the elastic deformation of joint spring part 530, and consequently, may prevent the conductive connection between connector 10 and circuit board 30.

In the conventional connector described above, the terminal is accommodated in the housing by press-fitting the terminal into a terminal accommodating portion defined by inner wall surfaces of the housing. Consequently, a very small gap is formed between the outer surfaces of the terminal and the wall surfaces that define the terminal accommodating portion under the condition where the terminal is accommodated in the housing. For that reason, when the mount portion of the terminal is soldered to a circuit board, a component of the solder may flow into the joint spring part by a capillary action, thereby preventing the elastic deformation of the joint spring part. In such a case, the conventional connector may prevent conductive connection between the connector and an object component.

In view of the problem, the connector in accordance with the present embodiment reduces the risk of preventing connective connection between connector 10 and circuit board 30, which is an object device.

Space S is formed in a region surrounding contact 50, which is a terminal. Space S extends from end 531*a* of root portion 531 near displaceable portion 532 to the end of stationary-side base body 540 near terminal part 550, i.e., tip end portion 542*a* of terminal arm part 542. Space S is provided in a surrounding region extending from end 531*a*, which is one end of contact 50, to tip end portion 542*a*, which is the other end thereof, thereby preventing flux, which is a component of mount agent 80, from flowing into displaceable portion 532 of joint spring part 530. In other words, the entry of flux due to capillary action is prevented from occurring on the side of displaceable portion 532 beyond space S.

In accordance with the present embodiment, recess 466*a* is provided in vertical wall 460 (central vertical wall portion 466) of housing 40, which is a region that faces contact 50. Internal space S1 of recess 466*a* constitutes at least a portion of space S (see FIGS. 5B, 9, and 11).

More specifically, joint spring part 530, which is the joint part, is inserted into central groove 472. The sides of central groove 472 are defined by the central portions of central vertical wall portions 466 that are adjacent to each other along the width direction Y. That is, joint spring part 530 is inserted in central groove 472 so as to face two central vertical wall portions 466 of housing 40 in the width direction Y, which crosses the relative movement direction of movable-side contact part 520 relative to stationary-side contact part 510. Thus, in accordance with the present embodiment, central vertical wall portion 466 of housing 40 is a wall that faces joint spring part 530, which is the joint part, in the width direction Y which crosses the relative movement direction of movable-side contact part 520 relative to stationary-side contact part 510.

Recesses 466*a* are formed in the regions of two central vertical wall portions 466 each serving as the wall described above that face end 531*a* of root portion 531 near displaceable portion 532.

In accordance with the present embodiment, each recess 466*a* has a rectangular parallelepiped shape elongated slenderly in the front-rear direction X. While contact 50 is press-fitted in accommodation slot 470 of housing 40, the portion of joint spring part 530 extending from the front end to the rear end faces recess 466*a* (see FIGS. 3 and 4). Recess 466*a* opens in the width direction Y. The surface of recess 466*a* farthest from side surface 50*c* of contact 50 in the width direction Y is the bottom of recess 466*a*.

Recess 466*a* is formed in central vertical wall portion 466 and extends in the up-down direction from a region of housing 40 that faces the tip end of root portion 531 to a region of displaceable portion 532 joined to movable-side contact part 520, which is the movable-side base part. Thus, in accordance with the present embodiment, recess 466*a* faces the entirety of end 531*a* of root portion 531 near displaceable portion 532. That is, space S is formed in an end near root portion 531 of contact 50 so that space S is connected from an end near root portion 531 through end 531*a* near displaceable portion 532 to displaceable portion 532.

In accordance with the present embodiment, housing 40 does not overlap front surface 530*b* and rear surface 530*c* of joint spring part 530 viewing in the front-rear direction X. Therefore, in the case that recess 466*a* as described above is formed in central vertical wall portion 466, space S opening in the front-rear direction X and demarcated by two recesses 466*a* in the width direction Y is formed around the entire circumference of a region around end 531*a* of root portion 531 near displaceable portion 532 (see FIG. 5B).

Thus, in accordance with the present embodiment, internal space S1 of recess 466*a* constitutes a portion of space S formed around the entire circumference in the vicinity of end 531*a* of root portion 531 near displaceable portion 532.

This configuration prevents formation of the very small gap extending from terminal part 550, which is the mount portion, to displaceable portion 532 when contact 50 is press-fitted into accommodation slot 470 of housing 40. That is, space S that prevents the capillary action is formed between terminal part 550 and displaceable portion 532.

As a result, flux, is a component of mount agent 80, is prevented from flowing into displaceable portion 532 of joint spring part 530 by the capillary action when terminal part 550, which is the mount portion, is soldered to circuit board 30, which is the object device, with mount agent 80 including solder and flux.

In accordance with the present embodiment, two recesses 543*b* and one recess 543*c* are formed alternately on one side and the other side across the width direction Y and are arranged alternately along the front-rear direction X, which is the extending direction in which stationary-side contact part 510, the base part, extends, as described above. When contacts 50 are accommodated in housing 40, plural recesses 543*b* and 543*c* also function as space S that prevents flux in mount agent 80 from flowing into displaceable portion 532 of joint spring part 530.

As described above, connector 10 according to the present embodiment includes housing 40 configure to have cable 20 (the object component) inserted therein, and contact 50 (the terminal) accommodated in housing 40 and configured to be conductively connected to cable 20.

Contact 50 includes stationary-side contact part 510 (the stationary-side base part) and movable-side contact part 520 (the movable-side base part) apart from stationary-side contact part 510. Contact 50 further includes joint spring part 530 (the joint part) that joins stationary-side contact part 510 to movable-side contact part 520 and that elastically deforms so as to move movable-side contact part 520 relative to stationary-side contact part 510.

Stationary-side contact part 510 includes stationary-side base body 540 accommodated in housing 40 so as to be restrained from relative movement, and terminal part 550 (the mount portion) connected to stationary-side base body 540 and mounted to circuit board 30 (the object device) by mount agent 80 (solder and flux).

Joint spring part 530 includes root portion 531 that is joined to stationary-side base body 540, and displaceable portion 532 that is connected to root portion 531 and that is displaced relative to root portion 531.

Space S preventing mount agent 80 from moving to displaceable portion 532 is formed around contact 50 between the end of root portion 531 near displaceable portion 532 and the end of stationary-side base body 540 near terminal part 550.

This configuration prevents flux, a component of mount agent 80, from flowing into displaceable portion 532 of joint spring part 530 by a capillary action when terminal part 550 is soldered to circuit board 30 with mount agent 80.

As a result, the elastic deformation of joint spring part 530 is not hindered, and conductive connection between connector 10 and cable 20 from being hindered.

In accordance with the present embodiment, space S surrounding the entire circumference of contact 50 is formed.

This configuration reliably prevents the flux from flowing into displaceable portion 532 of joint spring part 530, and reliably prevents the conductive connection between connector 10 and cable 20 from being hindered.

In accordance with the present embodiment, recess 466*a* is formed in at least one of regions of housing 40 and contact 50 that face each other. In addition, internal space S1 of recess 466*a* constitutes at least a portion of space S.

This configuration prevents the flux from flowing into displaceable portion 532 of joint spring part 530 without increasing the size of connector 10 along the width direction Y. That is, it is possible to prevent conductive connection between connector 10 and cable 20 from being hindered while preventing an increase in size of connector 10 as much as possible.

In accordance with the present embodiment, housing 40 includes central vertical wall 466 which faces joint spring portion 530 (the joint part) in the width direction Y which crosses the relative movement direction of the movable base relative to the stationary base. Recess 466*a* is formed in a region of central vertical wall portion 466 that faces end 531*a* of root portion 531 near displaceable portion 532.

Recess 466*a* is thus formed in central vertical wall portion 466 of housing 40. This configuration forms space S easily to prevent mount agent 80 from moving to displaceable portion 532. In addition, recess 466*a* is formed in a region of central vertical wall portion 466 that faces end 531*a* of root portion 531 near displaceable portion 532, thereby preventing the flux, a component of mount agent 80, from moving to displaceable portion 532 reliably.

In accordance with the present embodiment, space S is formed near root portion 531, and extends continuously to displaceable portion 532.

This configuration reliably prevents displaceable portion 532 from being adversely affected by flux.

In accordance with the present embodiment, plural, two projections 543*a* are provided on a side portion of the rear end of stationary-side base body 540 so as to protrude in the width direction Y. The two projections 543*a* are provided so that the entirety of stationary-side base body 540 protrudes from the bottom end to the top end in a width direction Y, and are arranged apart along the front-rear direction X.

This configuration allows recess 543*c* to be formed between the two projections 543*a* of stationary-side base body 540. As a result, recess 543*c* prevents flux from flowing into displaceable portion 532 of joint spring part 530.

In accordance with the present embodiment, recesses 543*b* are formed in regions of stationary-side base body 540 corresponding to projections 543*a*.

Two recesses 543*b* and one recess 543*c* function as space S while contact 50 (terminal) is accommodated in housing 40.

That is, in accordance with the present embodiment, space S includes two recesses 543*b* and one recess 543*c* formed in a region of stationary-side contact part 510 (the stationary-side base part) near terminal part 550 along the front-rear direction X which is an extending direction in which stationary-side contact part 510 extends. Plural recesses 543*b* and 543*c* are arranged alternately in one side and the other side and are arranged alternately along the width direction Y which crosses the extending direction of the stationary-side base part.

Figure 12A:
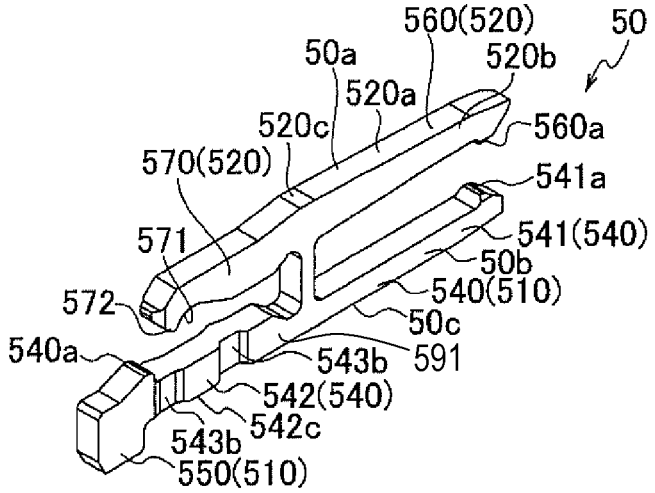
FIGS. 12A, 12B, 12C, 12D, and 12E are a perspective view, another perspective view, a side view, another side view, and a front view of a contact of the connector according to Embodiment 1, respectively.
Figure 12B:
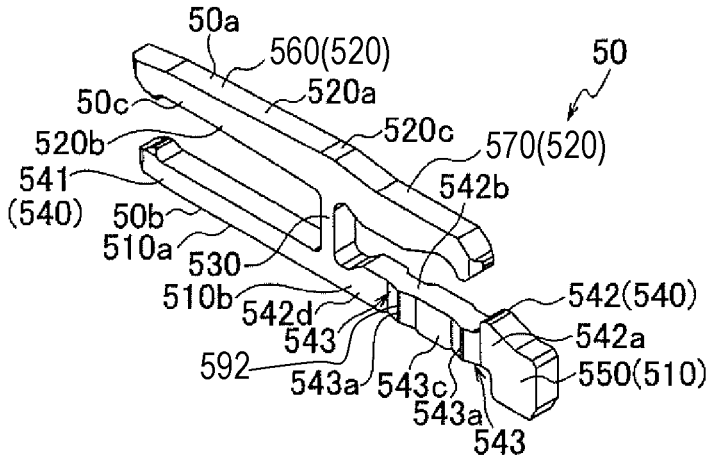
Figure 12C:
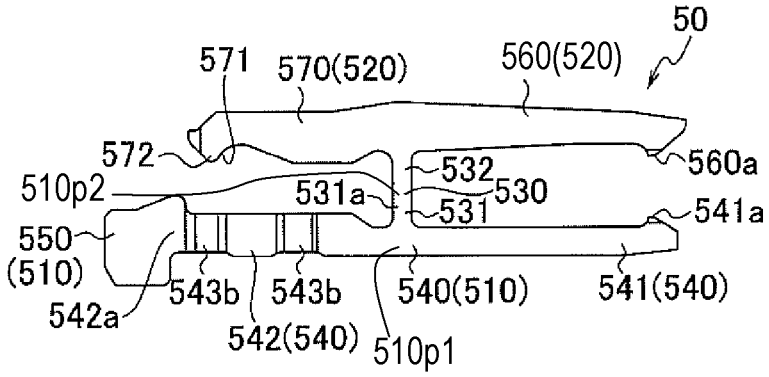
Figure 12D:
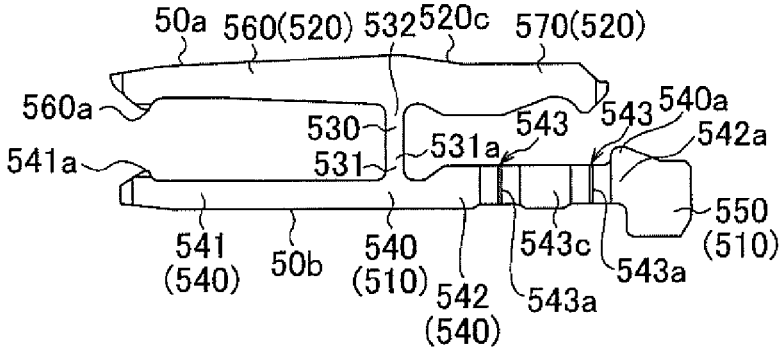
Figure 12E:
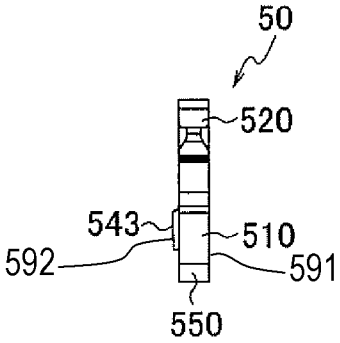

Specifically, as illustrated in FIGS. 12A, 12B, and 12E, stationary-side contact part 510, which is the base part, has surface 591 and surface 592 opposite to surface 591. Surface 591 extends in the width direction Y crossing the front-rear direction X Plural recesses 543*b* and 543*c* are formed alternately in surface 591 and surface 592 of stationary-side contact part 510 and arranged alternately along the front-rear direction X. Two recesses 543*b* are formed in surface 591 of stationary-side contact part 510. Recess 543*c* is formed in surface 592 of stationary-side contact part 510. No recess that faces space S is formed in surface 592 opposite to recesses 543*b* of stationary-side contact part 510 in the width direction Y. No recess that faces space S is formed in surface 591 opposite to recesses 543*c* of stationary-side contact part 510 in the width direction Y.

This configuration allows recess 543*b* and recess 543*c* to be formed in both sides of terminal part 550 (the mount portion) of stationary-side contact part 510 (the stationary-side base part) along the width direction Y. Therefore, the flux is reliably prevented from flowing into displaceable portion 532 of joint spring part 530.

Exemplary Embodiment 2

Figure 13:
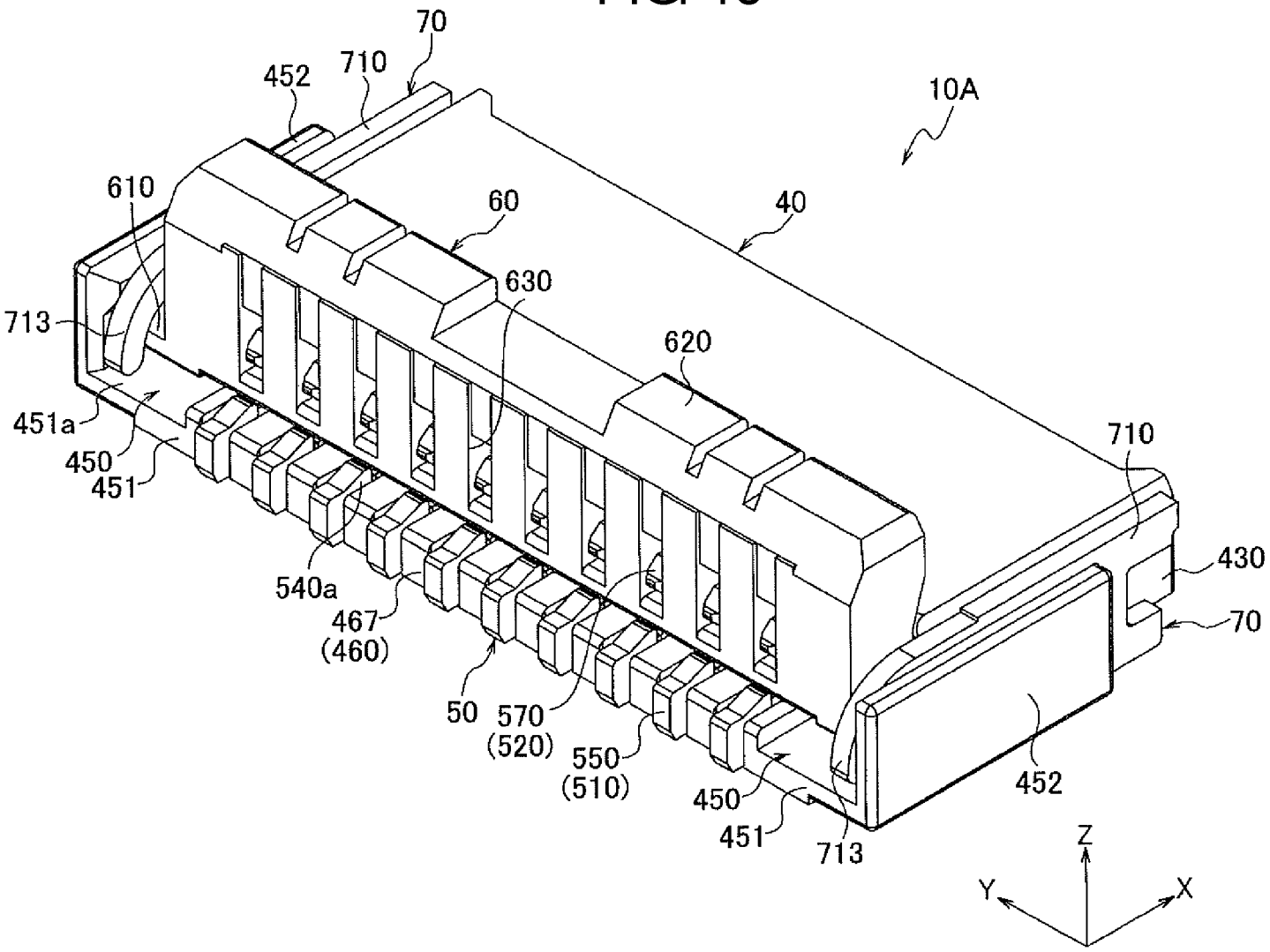
FIG. 13 is a perspective view of a connector according to Exemplary Embodiment 2 of the present invention.
Figure 14A:
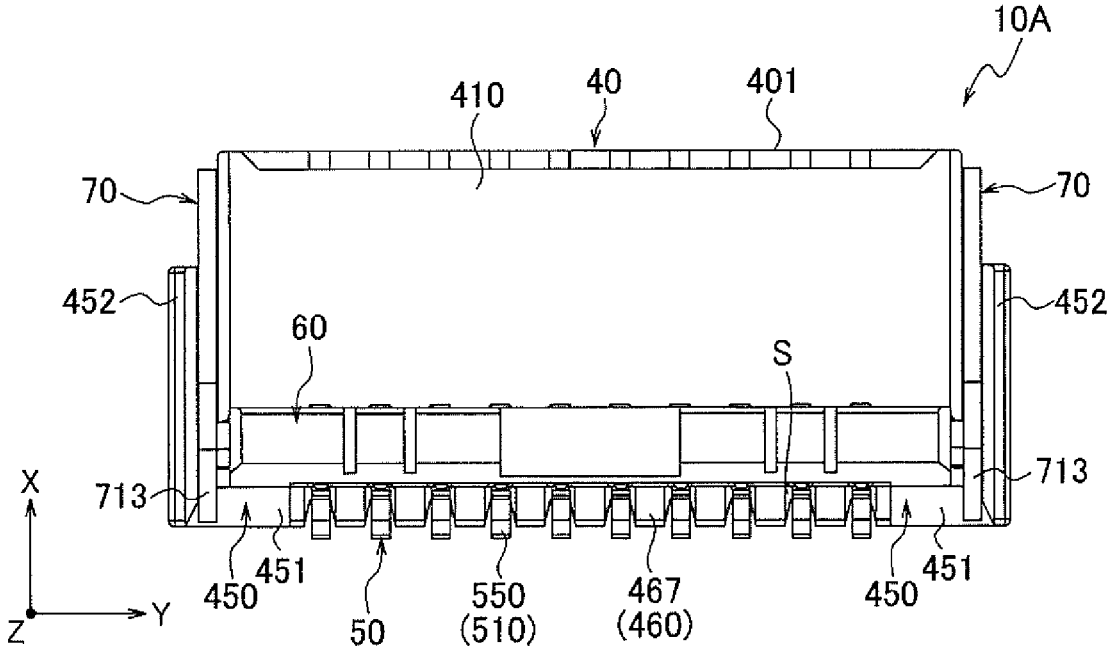
FIGS. 14A and 14B are a plan view and a rear view of the connector according to Embodiment 2, respectively.
Figure 14B:
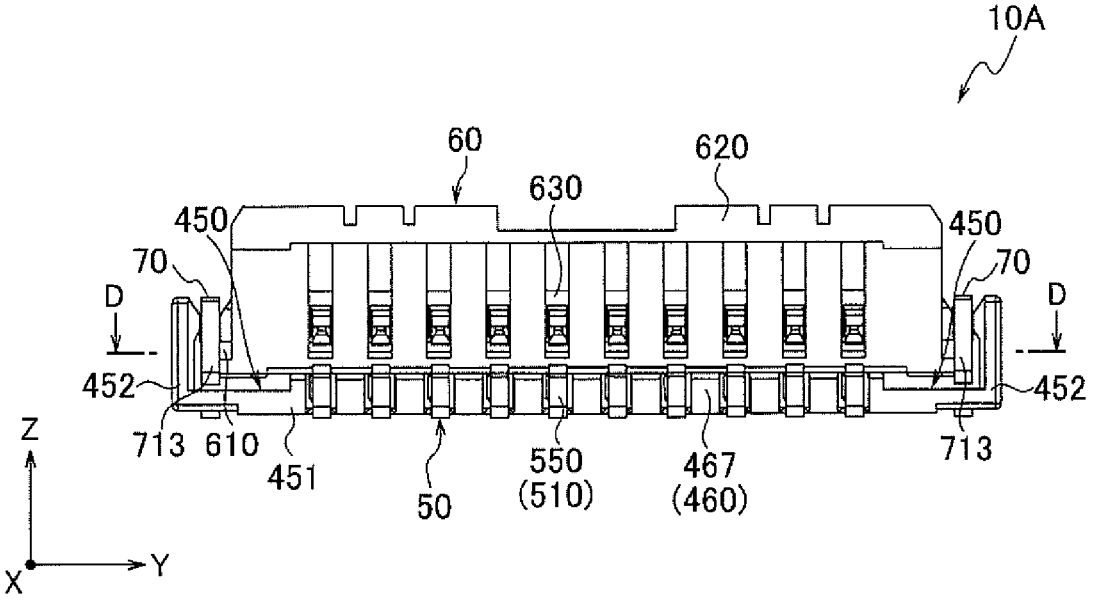
Figure 15:
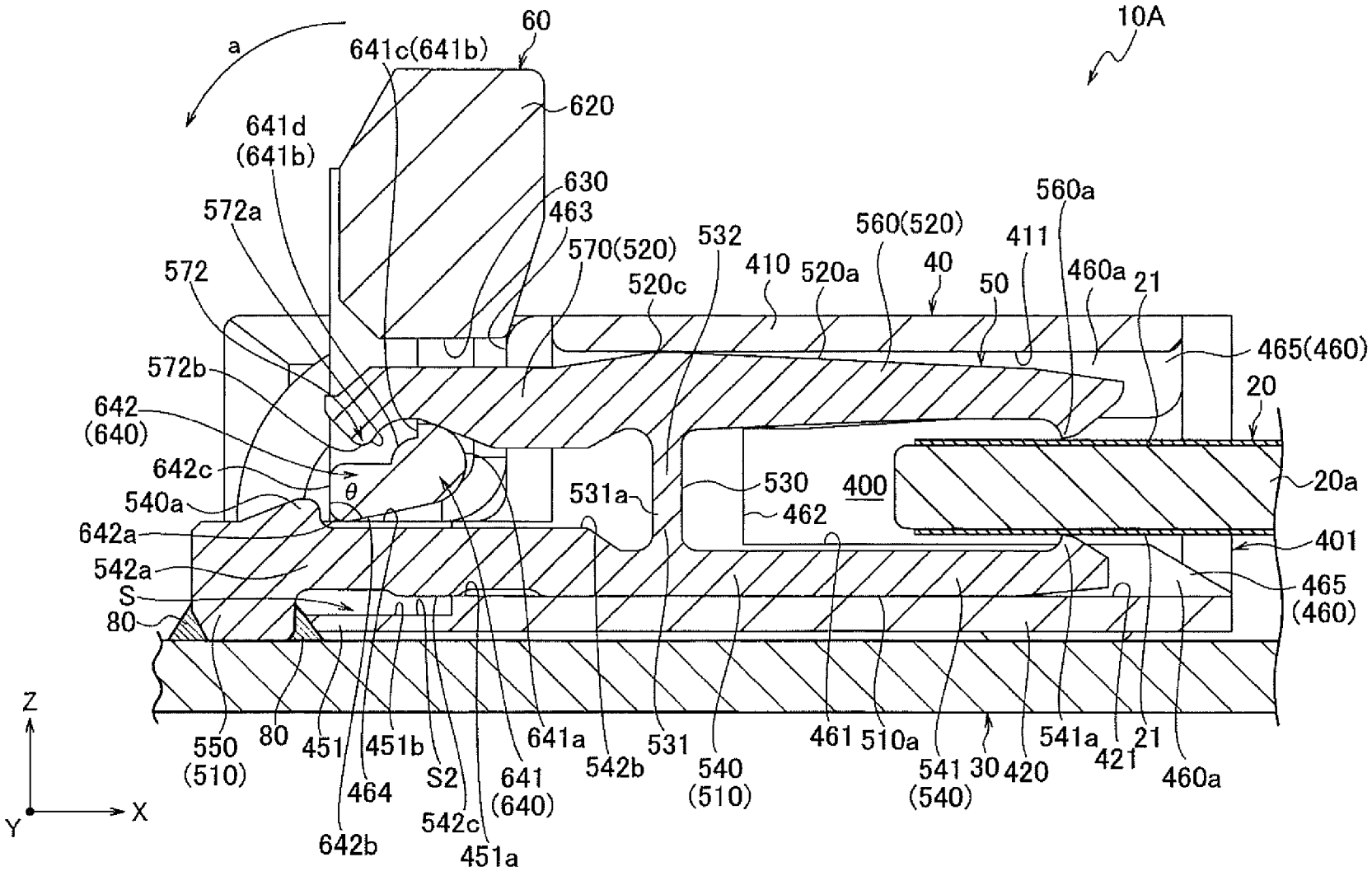
FIG. 15 is a side cross-sectional view of the connector according to Embodiment 2 in which a lever thereof is situated at an open position.
Figure 16A:
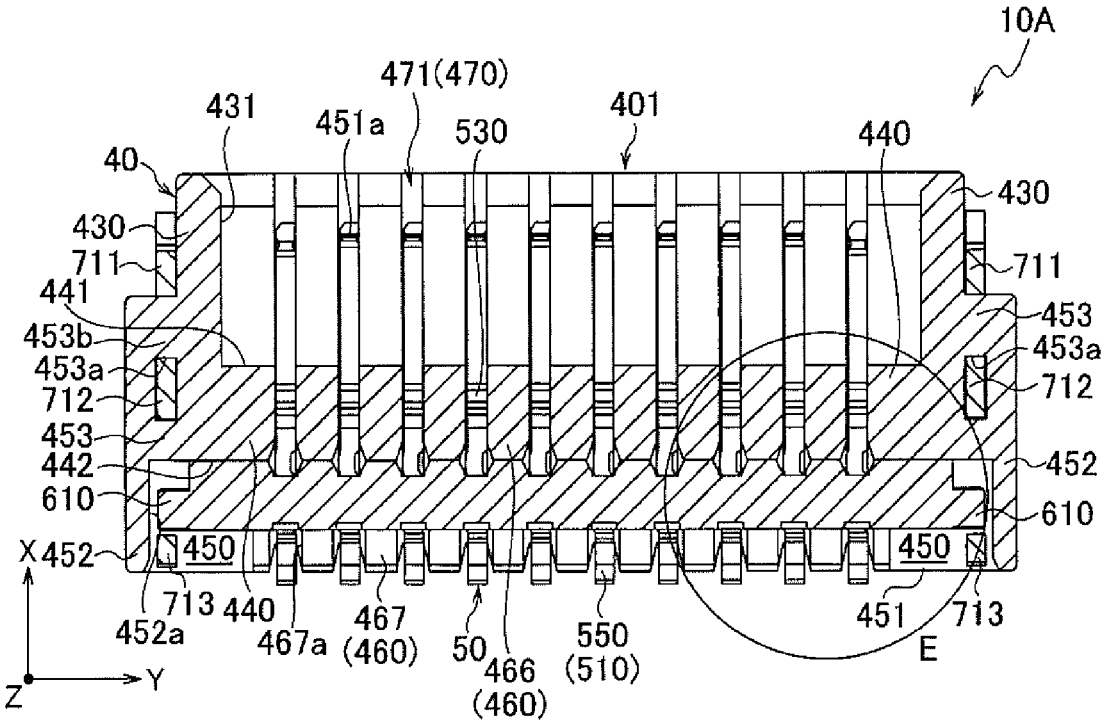
FIG. 16A is a cross-sectional view of the connector along line D-D shown in FIG. 14B.
Figure 16B:
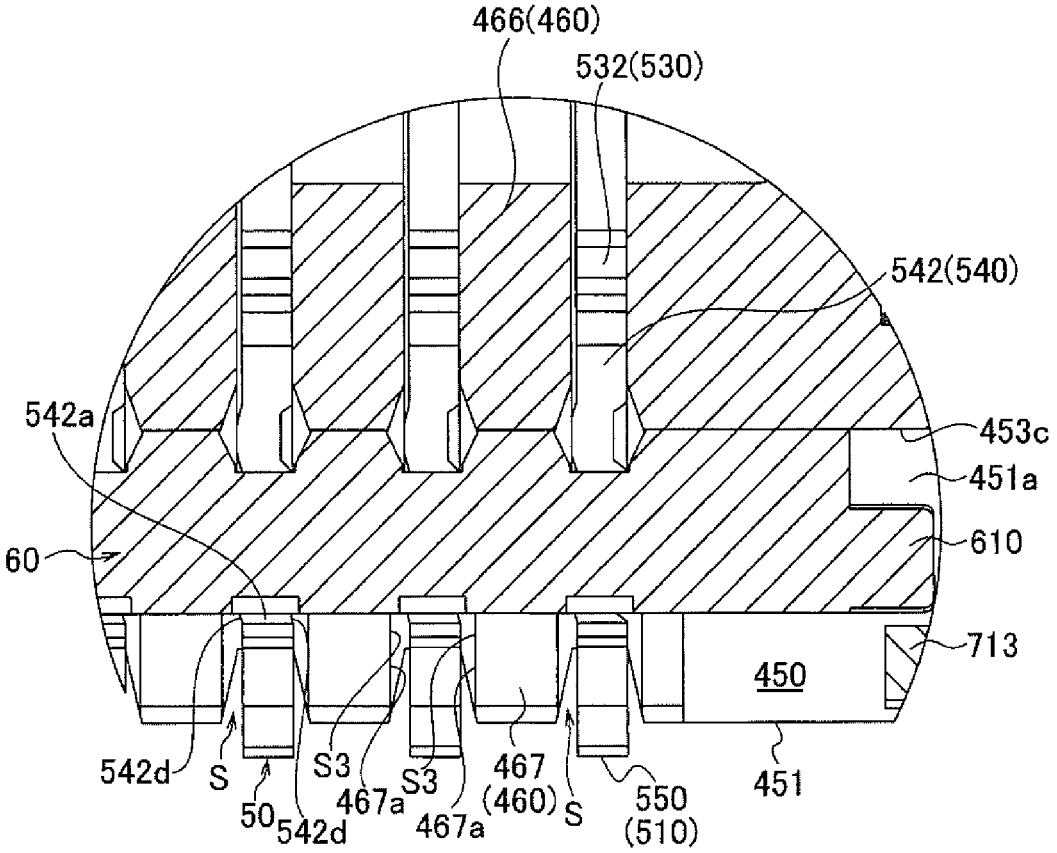
FIG. 16B is an enlarged view of portion E of the connector shown in FIG. 16A.
Figure 17:
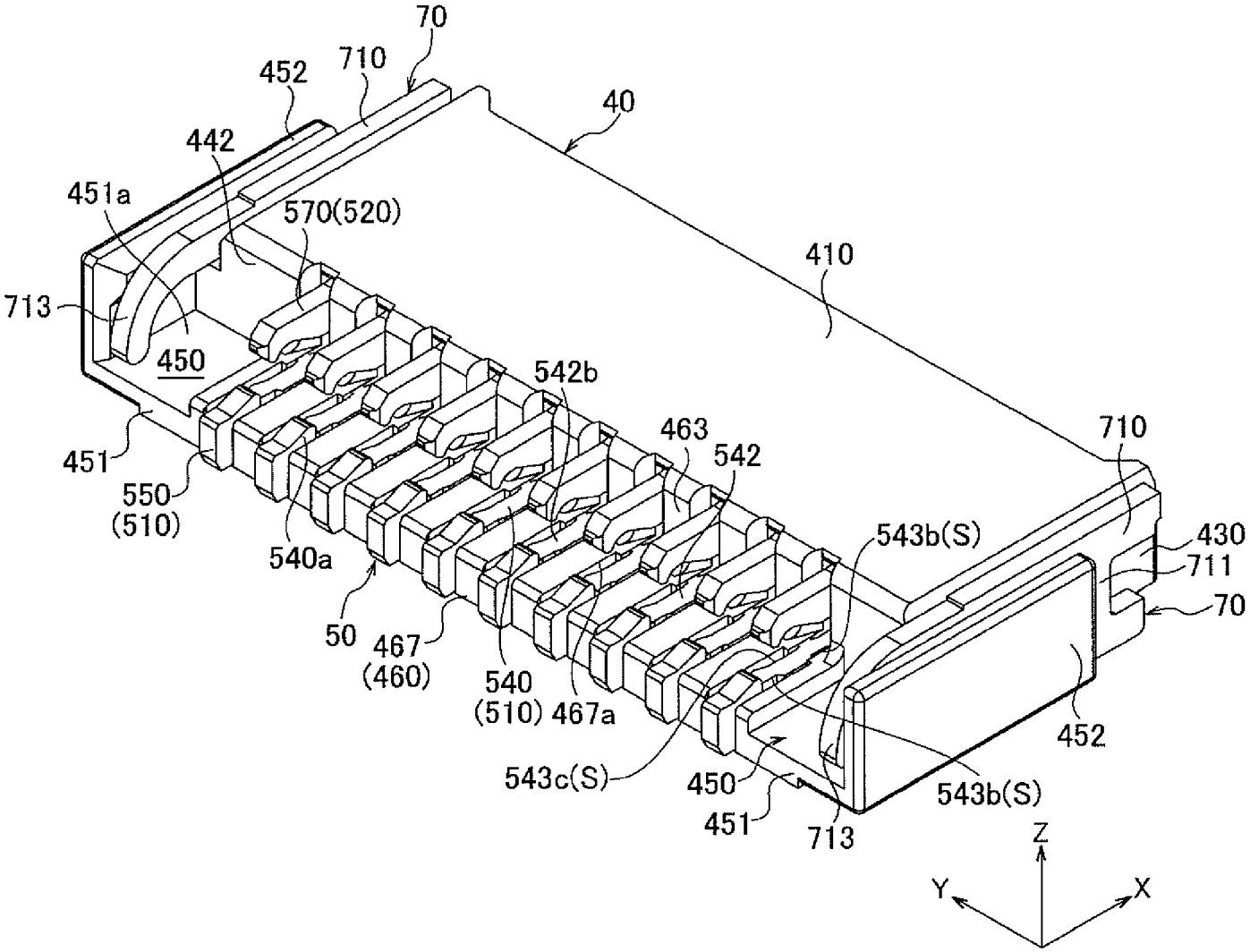
FIG. 17 is a perspective view of the connector according to Embodiment 2 from which the lever is removed.
Figure 18A:
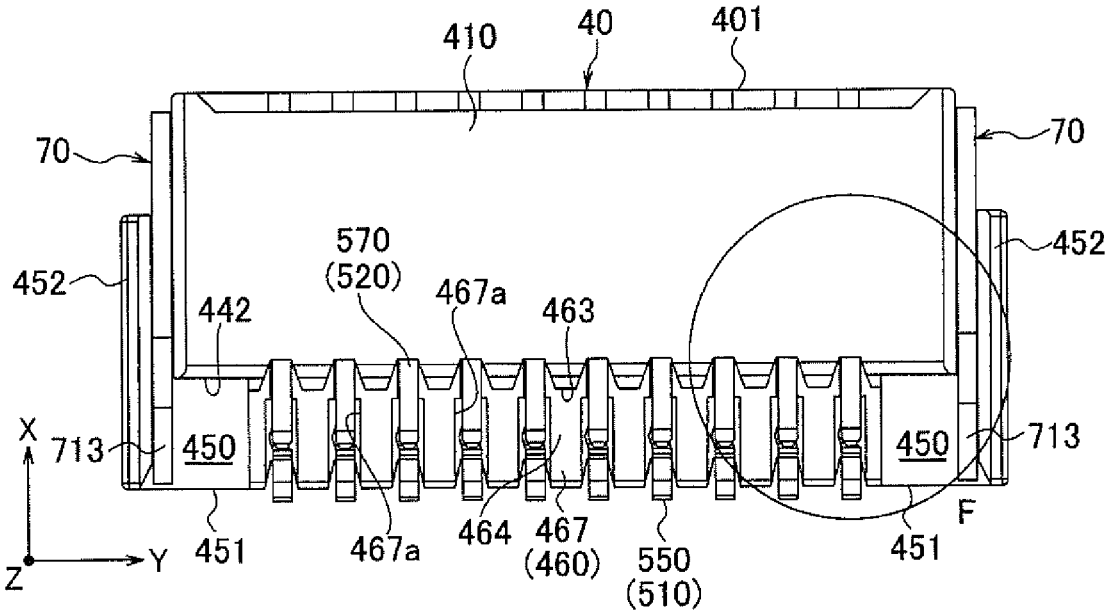
FIG. 18A is a plan view of the connector according to Embodiment 2 from which the lever is removed.
Figure 18B:
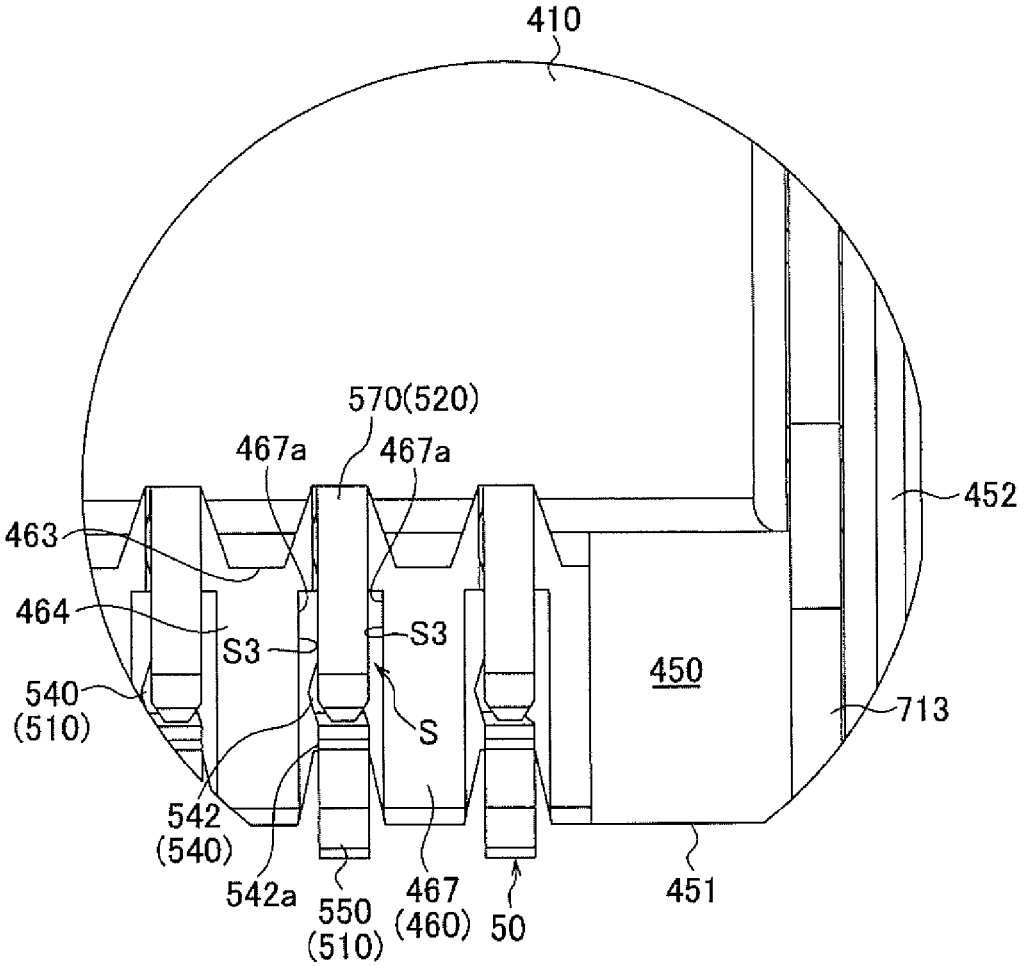
FIG. 18B is an enlarged view of portion F of the connector shown in FIG. 18A.
Figure 19:
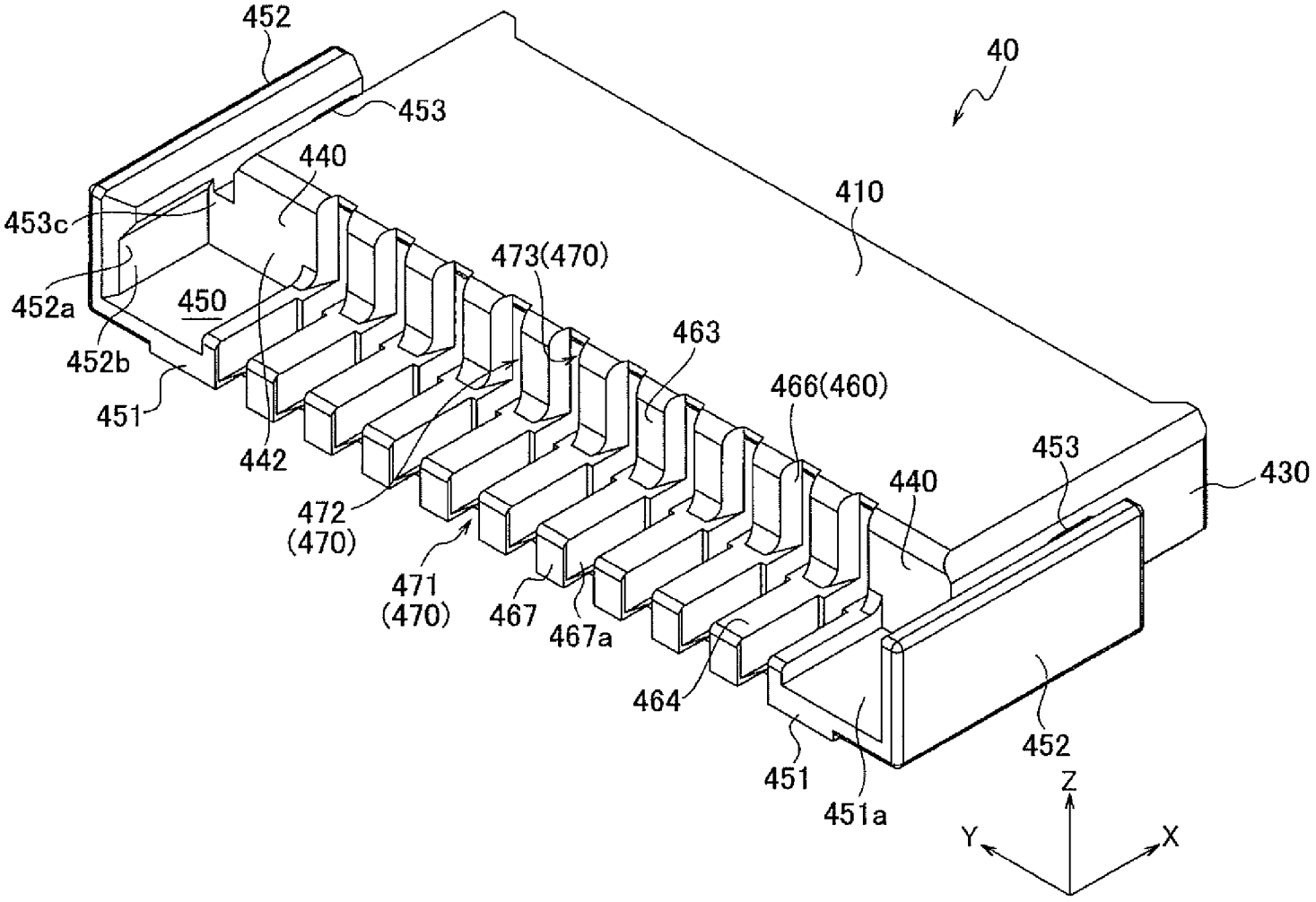
FIG. 19 is a perspective view of a housing of the connector according to Embodiment 2.
Figure 20A:
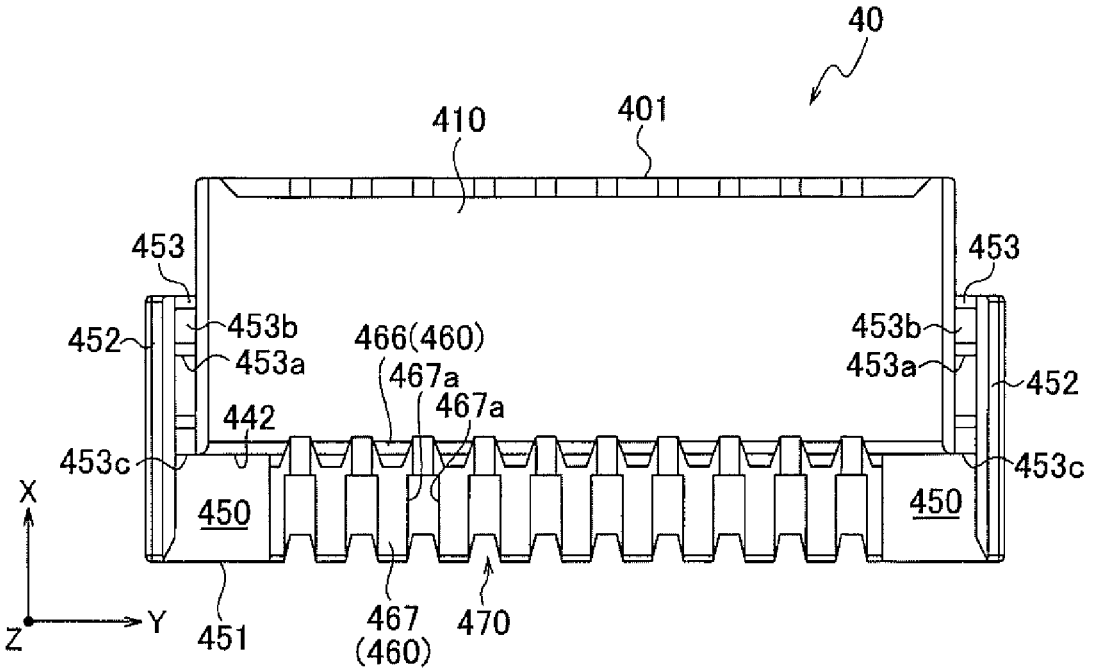
FIGS. 20A and 20B are a plan view and a rear view of the housing of the connector according to Embodiment 2, respectively.
Figure 20B:
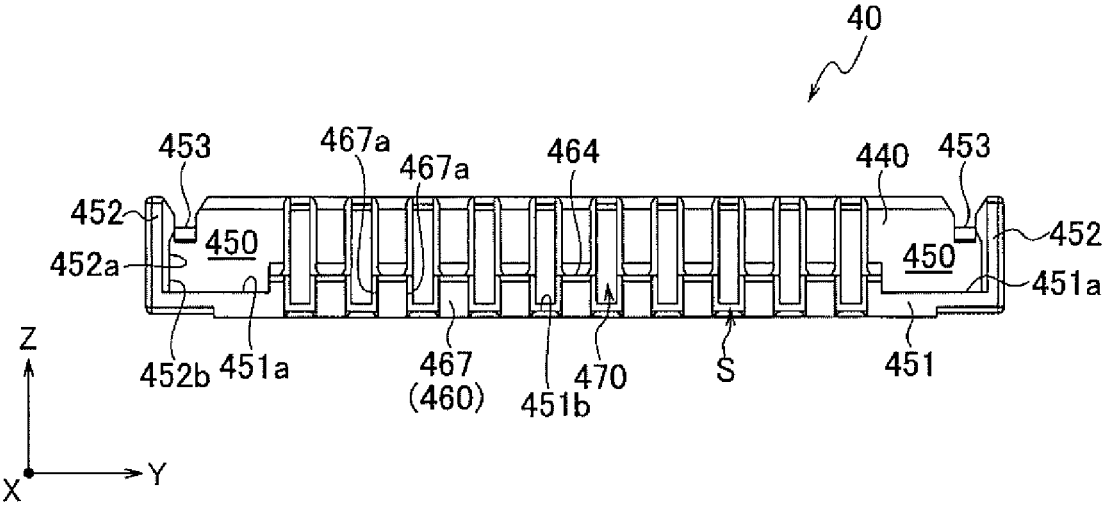
Figure 21:
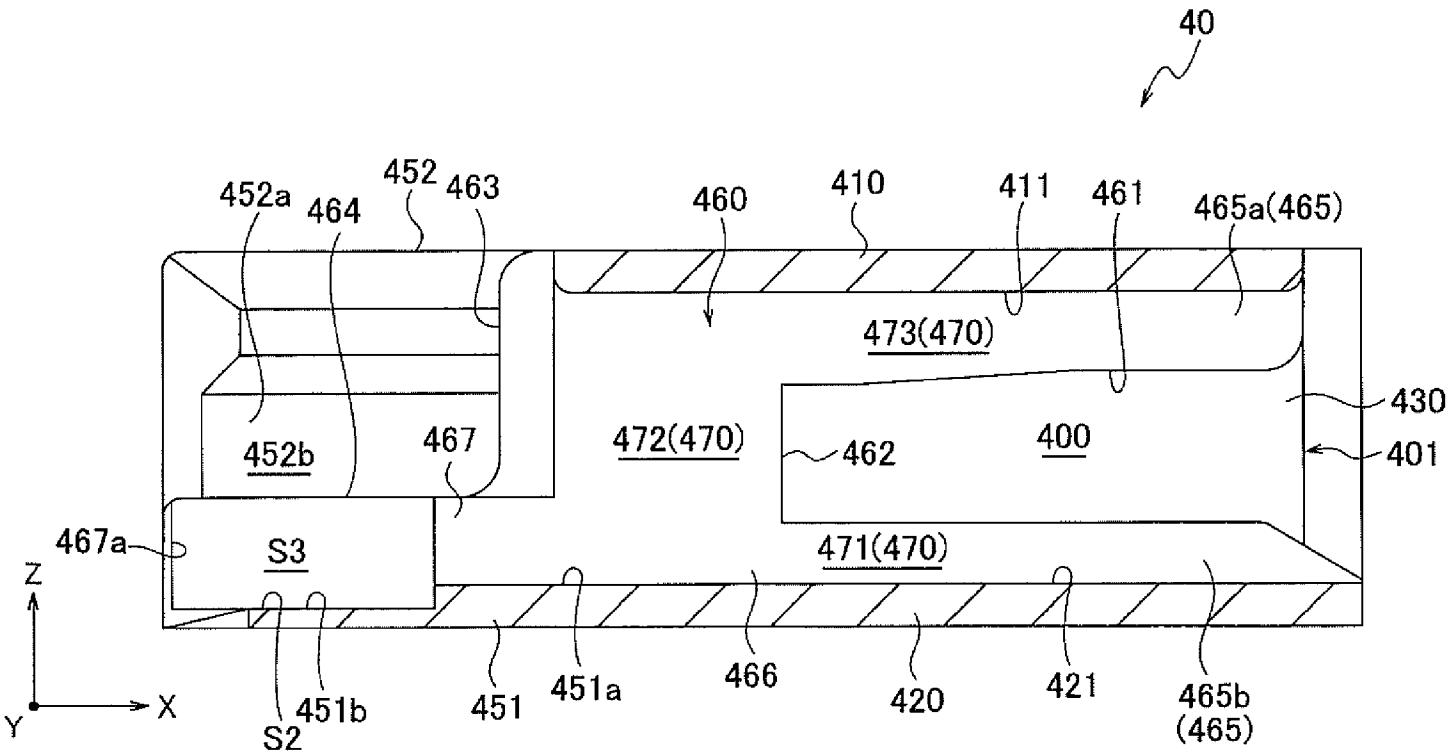
FIG. 21 is a side cross-sectional view of the housing of the connector according to Embodiment 2.
Figure 22A:
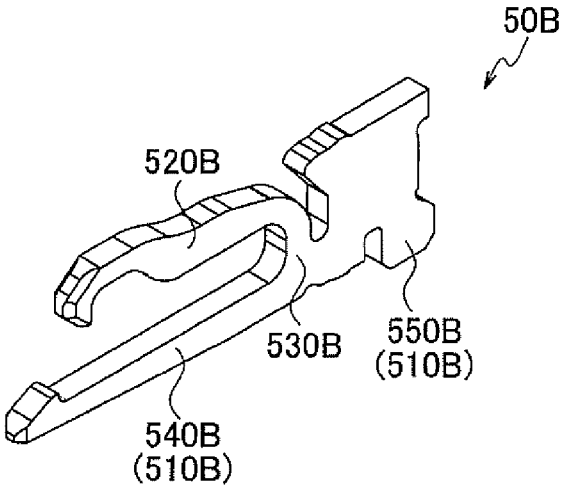
FIGS. 22A, 22B, 22C, and 22D are a perspective view, another perspective view, a side view, and a front view of a contact of a modified example of the connector according to Embodiment 2.
Figure 22B:
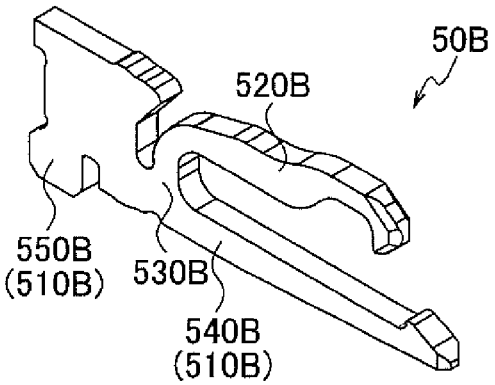
Figure 22C:
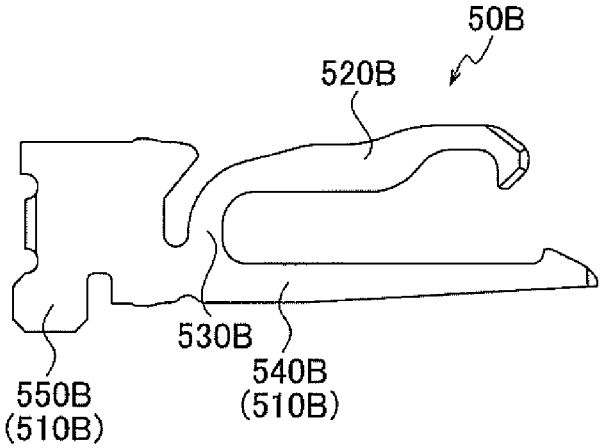
Figure 22D:
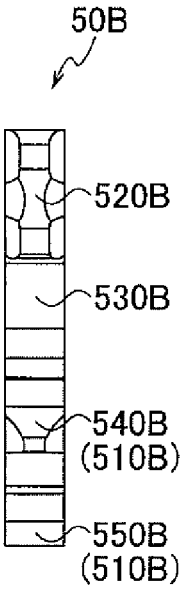

FIG. 13 is a perspective view of connector 10A according to Exemplary Embodiment 2 of the present invention. FIGS. 14A and 14B are a plan view and a rear view of connector 10A, respectively. FIG. 15 is a side cross-sectional view of connector 10A in which lever 60 is situated at the open position. FIG. 16A is a cross-sectional view of connector 10A along line D-D shown in FIG. 14B. FIG. 16B is an enlarged view of portion E of connector 10A shown in FIG. 16A. FIG. 17 is a perspective view of connector 10A from which lever 60 is removed. FIG. 18A is a plan view of connector 10A from which lever 60 is removed. FIG. 18B is an enlarged view of portion F of connector 10A shown in FIG. 18A. FIG. 19 is a perspective view of housing 40 of connector 10A. FIGS. 20A and 20B are a plan view and a rear view of housing 40 of connector 10A, respectively. FIG. 21 is a side cross-sectional view of housing 40 of connector 10A.

Connector 10A according to the present embodiment basically has a structure similar to that of connector 10 in accordance with Embodiment 1.

Specifically, as illustrated in FIGS. 13 to 21, connector 10A according to the present embodiment includes insulative housing 40 configured to have cable 20, an object component, such as an FPC or an FFC, inserted therein. Cable 20 has a sheet shape, i.e., a plate shape having an obverse surface and a rear surface. Connector 10 further includes contacts 50 which are plural terminals that are accommodated in housing 40 and that are conductively connected to conductors 21 of cable 20.

Insulative lever 60 is attached rotatably to housing 40. Lever 60 is attached to housing 40 rotatably between the open position at which cable 20 can be inserted into housing 40, and the closed position, at which cable 20 inserted in housing 40 is clamped by contacts 50.

In accordance with the present embodiment as well, plural accommodation slots 470 accommodating contacts 50 in housing 40 penetrate housing 40 along the front-rear direction X. Contacts 50 having substantially H-shapes are press-fitted into accommodation slots 470 from the rear, so that each of accommodation slots 470 accommodates respective one of contacts 50. The shape of each contact 50 is the same shape as contact 50 in accordance with Embodiment 1.

The connector according to the present embodiment does not obstruct connective connection between connector 10 and circuit board 30, which is the object device.

Specifically, space S preventing mount agent 80 including solder and flux from moving to displaceable portion 532 is formed in a region that surrounds contact 50 and that extends from end 531*a* of root portion 531 near displaceable portion 532 to the end of stationary-side base body 540 near terminal part 550, i.e., tip end portion 542*a* of terminal arm part 542.

In accordance with the present embodiment, space S is formed in a region near terminal part 550, which is the mount portion, of contact 50, which is the terminal.

Specifically, space S is formed by providing a recess in at least one of regions of housing 40 and contact 50 (the terminal) that face each other near terminal part 550 (the mount portion) of contact 50 (the terminal).

In accordance with the present embodiment, recess 451*b* is provided in extension wall 451, and recess 467*a* is provided in rear vertical wall portion 467 of vertical wall 460 so as to communicate with recess 451*b*. Internal space S2 of recess 451*b* and internal space S3 of recess 467*a* constitute at least a portion of space S (see FIGS. 15, 16A, and 16B, and FIGS. 20A and 20B).

Recess 451*b* opens upward and rearward. While contact 50 is press-fitted in accommodation slot 470 of housing 40, a portion of lower surface 542*c* of terminal arm part 542 extending from one end thereof to the other end thereof along the width direction Y faces recess 451*b* (see FIGS. 18A and 18B).

Recess 467*a* opens upward and in the width direction Y, and the surface of recess 467*a* that is farthest from side surface 50*c* of contact 50 in the width direction Y is the bottom of recess 467*a*. Recess 467*a* is formed in rear vertical wall portion 467 so that a portion of side surface 542*d* of terminal arm part 542 extending from the lower end thereof to the upper end faces recess 467*a* while contact 50 is press-fitted into accommodation slot 470 of housing 40 (see FIG. 15).

In accordance with the present embodiment, the side of terminal part 550 (the mount portion) near the terminal arm part 542 also faces recess 451*b* and recess 467*a*. That is, space S is formed in the side of contact 50 near terminal part 550 (the mount portion). Space S is connected from an end near terminal arm part 542 through tip end portion 542*a* which is an end near terminal part 550 (mount portion), to terminal part 550 (the mount portion).

In accordance with the present embodiment, housing 40 does not exist in a region of upper surface 542*b* of terminal arm part 542 in which recess 467*a* is formed (see FIGS. 18A and 18B). Thus, in accordance with the present embodiment, recess 451*b* is formed in extension wall 451, and recess 467*a* is formed in rear vertical wall portion 467. With this configuration, space S opens upward. The bottom side of space S is demarcated by recess 451*b*. The sides of space S along the width direction Y are demarcated by two recesses 467*a*. Space S is formed over the entire circumference around tip end portion 542*a* which is the end of terminal arm part 542 near the mount portion.

The connector according to the present embodiment provides the same advantageous effects as the connector according to Embodiment 1.

In accordance with the present embodiment, space S is formed in an end near terminal part 550, and is connected to terminal part 550 (the mount portion).

This configuration reduces the amount of the flux (a predetermined component of mount agent 80) that flows into a gap between stationary-side base body 540 and housing 40. As a result, it is possible to reliably prevent the flux from flowing into displaceable portion 532 of joint spring part 530 (the joint part) and to reliably prevent conductive connection between connector 10 and cable 20 (the object component) from being hindered.

Although preferred embodiments of the present invention have been described hereinabove, it should be understood that the present invention is not limited to the foregoing exemplary embodiments but may be modified in various other forms.

For example, although the foregoing exemplary embodiments have illustrated examples that includes contact 50 (the terminal) having substantially an H-shape, the shape of the contact is not limited thereto, and it is possible to use contacts (terminals) in various other shapes.

FIGS. 22A, 22B, 22C, and 22D are a perspective view, another perspective view, a side view, and a front view of contact 50B of a modified example of connector 10A according to Embodiment 2, respectively.

For example, the present invention is applicable to a connector that employs contact 50B shown in FIGS. 22A to 22D.

Contact 50B shown in FIGS. 22A to 22D includes lower arm part 510B, which is a stationary-side base part, and upper arm part 520B, which is a movable-side base part, apart from lower arm part 510B. Lower arm part 510B and upper arm part 520B are joined together with joint spring part 530B, which is a joint part. Joint spring part 530B elastically deforms so as to move upper arm part 520B relative to lower arm part 510B.

Lower arm part 510B includes lower arm body 540B which is a movable-side base part. Terminal part 550B (the mount portion), which is to be mounted onto a circuit board (the object device) with a mount agent (solder or flux) is connected to lower arm body 540B.

The space described in Embodiment 1 and the space described in Embodiment 2 maybe formed. Specifically, a space preventing the flux (the mount agent) from flowing into the displaceable portion of the joint spring part may be provided on the root portion side and the mount portion side.

Furthermore, although the foregoing exemplary embodiments have illustrated examples in which the space is produced by forming recesses in the housing, it is also possible that the space may be formed by providing recesses in the contact (terminal) without forming recesses in the housing. It is also possible that the space may be formed by providing recesses in both the housing and the contact (terminal).

In addition, although the foregoing exemplary embodiments have illustrated connectors in which one type of contact (terminal) is accommodated in the housing, the present invention is also applicable to a connector that accommodates a plurality of types of contacts (terminals).

It is also possible that the housing may accommodate a retaining terminal, and the retaining terminal may interlock the cable.

It is also possible to modify the specifications (such as shape, size, and layout) of the housing, the lever, and other specific parts.

What is claimed is:

1. A connector comprising:

a housing configured to have an object component be inserted therein; and a terminal accommodated in the housing and configured to be conductively connected to the object component, wherein the terminal includes:

a first base part;

a second base part disposed apart from the first base part; and a joint part joining the first base part to the second base part, the joint part being configured to elastically deform so as to allow the second base part to move relative to the first base part, wherein the first base part includes:

a base body; and a mount portion connected to the base body at a first connection point, the mount portion being mountable onto an object device with a mount agent, wherein the joint part includes:

a root portion joined to the base body; and a displaceable portion connected to the root portion at a second connection point, the displaceable portion being displaceable relative to the root portion, wherein a space preventing the mount agent from moving to the displaceable portion is formed around a portion of the terminal between the second connection point and the first connection point, wherein the housing includes:

a first portion facing, across the space, the portion of the terminal between the second connection point and the first connection point; and a second portion facing the mount portion of the first base part of the terminal not across the space, and wherein a distance between the first portion of the housing and the portion of the terminal between the second connection point and the first connection point is larger than a distance between the second portion of the housing and the mount portion of the first base part of the terminal.

2. The connector according to claim 1, wherein the space surrounds an entire circumference of the terminal.

3. The connector according to claim 1, wherein a recess is formed in at least one of regions of the housing and the terminal that face each other, and wherein an internal space of the recess constitutes at least a portion of the space.

4. The connector according to claim 3, wherein the joint part is elastically deformable so as to allow the second base part to move relative to the first base part in a relative movement direction, wherein the housing includes a wall part facing the joint part in a direction crossing the relative movement direction, wherein the recess is formed in a region of the wall part facing the second connection point, wherein the first portion of the housing faces the portion of the terminal between the second connection point and the first connection point in the direction crossing the relative movement direction, wherein the second portion of the housing faces the mount portion of the first base part of the terminal in the direction crossing the relative movement direction, wherein a bottom of the recess includes the first portion of the housing, and wherein a portion of the wall part except the recess includes the second portion of the housing.

5. The connector according to claim 4, wherein a distance between the bottom of the recess and the portion of the terminal between the second connection point and the first connection point in the direction crossing the relative movement direction is larger than a distance between the portion of the wall part except the recess and the mount portion of the first base part of the terminal in the direction crossing the relative movement direction.

6. The connector according to claim 3, wherein the housing has an opening such that the second base part of the terminal protrudes from the opening of the housing, and wherein the recess is provided along the second base part of the terminal, and is closer to the space than the opening of the housing.

7. The connector according to claim 6, wherein one end of the recess is connected to the space, and wherein another end of the recess does not reach an outer edge of the opening of the housing.

8. The connector according to claim 6, wherein the recess does not reach the opening of the housing.

9. The connector according to claim 3, wherein the housing has an opening such that the second base part of the terminal protrudes from the opening of the housing, and wherein the recess is provided in the second base part of the terminal, and is located more inside of the housing than the opening of the housing.

10. The connector according to claim 9, wherein one end of the recess is connected to the space, and wherein another end of the recess does not reach an outer edge of the opening of the housing.

11. The connector according to claim 9, wherein the recess does not reach the opening of the housing.

12. The connector according to claim 1, wherein the space extends to the displaceable portion.

13. The connector according to claim 1, wherein the space extends to the mount portion.

14. The connector according to claim 1, wherein the first base part extends in an extending direction, wherein a plurality of recesses facing the space are formed in the mount portion of the first base part, wherein the first base part has a first surface and a second surface opposite to the first surface, the first surface extending in a direction crossing the extending direction, and wherein the plurality of recesses are arranged alternately along the extending direction in the first surface and the second surface of the first base part along the extending direction.

15. The connector according to claim 14, wherein no recess facing the space is formed in a surface of the first base part opposite to the plurality of recesses in the direction crossing the extending direction.

* * * * *